US006767862B2

(12) United States Patent
Minami et al.

(10) Patent No.: US 6,767,862 B2
(45) Date of Patent: Jul. 27, 2004

(54) THERMAL RECORDING MATERIAL

(75) Inventors: Kazumori Minami, Shizuoka-ken (JP); Yoshihiro Jinbo, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 303 days.

(21) Appl. No.: 10/091,456

(22) Filed: Mar. 7, 2002

(65) Prior Publication Data

US 2002/0172805 A1 Nov. 21, 2002

(30) Foreign Application Priority Data

Mar. 8, 2001 (JP) ..... 2001-065692

(51) Int. Cl.[7] ..... B41M 5/30
(52) U.S. Cl. ..... 503/216; 503/217
(58) Field of Search ..... 503/216, 217; 430/154, 157

(56) References Cited

FOREIGN PATENT DOCUMENTS

| | | |
|---|---|---|
| JP | 8-324129 | 12/1996 |
| JP | 11-78232 | 3/1999 |
| JP | 2001-138639 | 5/2001 |
| JP | 2001-219659 | 8/2001 |
| JP | 2001-232948 | 8/2001 |
| JP | 2002-3738 | 1/2002 |

*Primary Examiner*—N. Edwards
(74) *Attorney, Agent, or Firm*—Sughrue Mion, PLLC

(57) ABSTRACT

A thermal recording material having good image storability and good lightfastness. The recording material does not have background fogging, even when exposed to light in a broad wavelength range or exposed to high-temperature surroundings. The recording material has a thermal recording layer provided on a support, and the thermal recording layer contains a compound of general formula (1), a compound of general formula (2), and a compound of general formula (3).

General Formula (1)

General Formula (2)

General Formula (3)

16 Claims, No Drawings

THERMAL RECORDING MATERIAL

BACKGROUND OF THE INVENTION

1. Field of the Invention

The present invention relates to a thermal recording material that forms color images thereon through reaction of a diazo compound and a coupler compound therein.

2. Description of the Related Art

Diazonium salt compounds have an extremely high chemical activity, and they react readily with phenol derivatives and active methylene-having compounds that are generally referred to as coupling components to form azo dyes. In addition, being sensitive to light, they decompose when exposed to light, and lose their activity. Accordingly, diazonium salt compounds have been used for many years for optical recording materials, for example, typically for diazo copies (see *Principles of Photographic Science and Engineering*—Non-Silver Salt Photography, edited by the Photographic Society of Japan, published by Corona Publishing Co., LTD., 1982, pp. 89–117, pp. 182–201).

These days, in addition, diazonium salt compounds are applied also to recording materials that require image fixation, as they have the property of decomposing through exposure to light to lose their activity. One typical example is a photo-fixing, thermal recording material in which the recording layer contains a diazonium salt compound and a coupling component that are reacted under heat in accordance with an image signal applied thereto to thereby form the intended image and the image is then fixed through exposure to light (Koji Sato et al., *the Journal of the Imaging Electronics Society of Japan*, Vol. 11, No. 4, 1982, pp. 290–296).

However, in the recording materials of this type that contain a diazonium salt compound serving as a color-forming component therein, the chemical activity of the diazonium salt compound is extremely high, and the diazonium salt compound therein gradually decomposes under heat even in the dark to lose its activity. Therefore, the drawback of the recording materials is that their shelf life is short. In addition, the diazonium salt compound still remaining in the non-image background area of the recording materials decomposes to form a color stain while the materials are exposed to light for image fixation thereon, and, as a result, the non-image background area of the thus processed materials is stained. This is another drawback of the recording materials. Moreover, even in the finished materials in which the image formed has been finally fixed, the non-image area is poorly resistant to light, and therefore the stain in the non-image area often increases when the finished materials are left in sunlight or under fluorescent lamps for a long period of time. This is still another drawback of the recording materials.

Various methods have heretofore been proposed for improving the stability of such diazonium salt compounds. One of the most effective methods is to encapsulate a diazonium salt compound into microcapsules. Encapsulated in microcapsules, the diazonium salt compound is isolated from water and bases that promote the decomposition of the compound. In that condition, therefore, the diazonium salt compound is almost completely prevented from being decomposed, and the shelf life of recording materials that contain the diazonium salt compound in microcapsules is significantly prolonged (Tomomasa Usami et al., *The Journal of the Electrophotography Society of Japan*, Vol. 26, No. 2, 1987, pp. 115–125).

One general method for encapsulating a diazonium salt compound into microcapsules is as follows: A diazonium salt compound is dissolved in a hydrophobic solvent (to form an oily phase), and this is added to an aqueous solution of a water-soluble polymer (aqueous phase), and emulsified and dispersed by the use of a homogenizer or the like. In the process, a monomer or a prepolymer to form a wall of microcapsules is added to either one or both of the oily phase and/or the aqueous phase so that it is polymerized in the interface between the oily phase and the aqueous phase to form a polymer wall around the emulsified particles of the diazonium salt compound to thereby encapsulate the diazonium salt compound into the thus-formed microcapsules. The details of the method are described, for example, in Tomoji Kondo's *Microcapsules* (by Nikkan Kogyo Shinbun, 1970) and Tamotsu Kondo et al's *Microcapsules* (by Sankyo Publishing, 1977).

For the microcapsule walls to be formed, various compounds are usable, for example, crosslinked gelatin, alginates, celluloses, urea resins, urethane resins, melamine resins, and nylon resins.

In cases where microcapsule walls are made of urea resin or urethane resin that undergoes phase transition at its glass transition point and where the glass transition point of the microcapsule walls is higher than room temperature to some extent, the microcapsule walls are impervious to substances at room temperature but are pervious thereto at temperatures not lower than their glass transition point. Therefore, the microcapsules of this type are referred to as thermo-responsive microcapsules, and these are useful in thermal recording materials.

Specifically, a thermal recording material having, on a support, a thermal recording layer that contains thermo-responsive microcapsules with a diazonium salt compound therein and a coupling component as the essential color-forming ingredients ensures long-term stability of the diazonium compound therein. When exposed to heat, it readily forms a color image thereon, and when exposed to light, the color image formed is fixed on it.

As in the above, the technique of encapsulating a diazonium salt compound into microcapsules makes it possible to significantly improve the stability of thermal recording materials that contain microcapsules of a diazonium salt compound therein.

However, even in microcapsules, diazonium salt compounds could not be well stabilized because of the property intrinsic thereto, and no one has heretofore succeeded in attaining satisfactory long-term stability of thermal recording materials containing diazonium salt compounds. This is because diazonium salt compounds undergo optical decomposition when exposed to light, and the diazo group therein therefore decomposes in that condition to form photo-decomposition stains. In addition, color stains also increase, and, as a result, the whiteness in the non-image area of the photo-fixed materials lowers and the contrast between the non-color area and the color area thereof lowers.

Further, it is known that the reaction is not uniform and therefore gives various decomposed products depending on the ambient environment. Of tens or more different types of the decomposed products, those referred to as photo-decomposition stains absorb visible rays. If the stains of this type are significant, the whiteness in the non-recorded area of the photo-fixed materials lowers, and the contrast between the image area and the non-image area lowers. If so, the commercial value of the recording materials is greatly lowered. However, the mechanism of photo-decomposition of diazonium salt compounds is complicated, and the decomposed products from them are difficult to specifically identify. For these reasons, it has heretofore been said in the art that photo-decomposition stains from diazonium salt compounds are difficult to control.

Given that situation, various studies are made these days in the art for solving the problem of photo-decomposition stains in thermal recording materials so as to improve the long-term stability of the materials. For example, in Japanese Patent application Laid-Open (JP-A) No.8-324129, proposed is a photo-fixing, thermal recording material for which are used microcapsules of a photo-fixing diazonium salt compound along with a specific hydrophobic oil. It is claimed that the recording material proposed has good storage stability and, after photo-fixing, the whiteness in the background area of the material is high. It is further claimed that, even if exposed to light for a long period of time after image formation thereon, the whiteness in the background area of the material and the image stability thereof are still good.

In JP-A No. 11-078232, proposed is a thermal recording material that comprises a novel diazonium salt compound. This is for improving the stability of the diazonium salt compound itself used therein. Concretely, the diazonium salt compound used therein is so modified that its maximum absorption wavelength is shifted shorter than around 350 nm, and therefore the diazonium salt compound is stable in a long wavelength range longer than around 350 nm. The thermal recording material proposed contains microcapsules of the diazonium salt compound of that type, and its advantages are that the whiteness in the non-image area of the material exposed to light longer than around 350 nm such as typically a fluorescent lamp for image formation thereon is high, and the discoloration in the image area thereof is retarded.

However, depending on the condition in which it is stored, the fixless thermal recording material is still unsatisfactory in point of its raw stock storability and in point of its ability to prevent stains in the background area thereof after processed for image formation thereon, and in addition, the image storability of the processed material is also still unsatisfactory.

In JP-A No. 2001-138639, proposed is a thermal recording material that comprises a fixless diazonium salt compound. It is claimed that the ability of the material to form color images is good, and the lightfastness of the image-formed material is also good. However, even the recording material that contains such a fixless diazonium salt compound is still unsatisfactory in point of its image storability after being exposed to light, and there still remains room for further improvement in the recording material proposed.

SUMMARY OF THE INVENTION

The present invention has been made in consideration of the above-mentioned problems, and its object is to provide a thermal recording material of good image storability.

The object of the present invention as above is attained as follows.

In its first aspect, the present invention provides a thermal recording material including: a support; and, a thermal recording layer provided on the support, and including a compound represented by the following general formula (1), a compound represented by the following general formula (2), and a compound represented by the general formula (3):

General Formula (1)

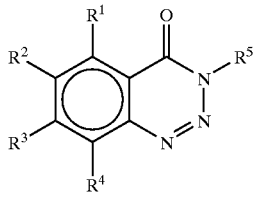

In general formula (1): $R^1$, $R^2$, $R^3$ and $R^4$ each independently represent a group selected from the group consisting of a hydrogen atom, halogen atoms, alkyl groups, aryl groups, $—OR^{51}$, $—SR^{51}$, $—COOR^{51}$, $—CONR^{51}R^{52}$, $—SO_2R^{51}$, $—SO_2NR^{51}R^{52}$, $—COR^{51}$, $—NR^{51}R^{52}$, nitro groups and cyano groups; $R^{51}$ and $R^{52}$ each independently represent a group selected from the group consisting of a hydrogen atom, alkyl groups, aryl groups and acyl groups; $R^5$ represents a group selected from the group consisting of a hydrogen atom, alkyl groups, aryl groups, $—COOR^{53}$, $—CONR^{53}R^{54}$, $—SO_2R^{53}$, $—SO_2NR^{53}R^{54}$, and $—COR^{53}$; and $R^{53}$ and $R^{54}$ each independently represent a group selected from the group consisting of a hydrogen atom, alkyl groups, aryl groups and acyl groups.

General Formula (2)

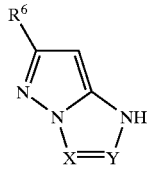

In general formula (2): $R^6$ represents an alkyl group or an aryl group; one of X and Y represents $C—R^7$ and the other of X and Y represents N; and $R^7$ represents an alkyl group or an aryl group.

$R_n—M_m$ General Formula (3)

In general formula (3): R represents an anion with a valency from 1 to 3; M represents a metal ion with a valency from 1 to 3; and n and m each independently represents an integer from 1 to 3.

A second aspect of the present invention is a thermal recording material subsidiary to the first aspect thereof, in which the compound represented by general formula (1) includes a solid content coating amount thereof from 0.1 to 0.8 mmol/$m^2$.

A third aspect of the present invention is a thermal recording material subsidiary to the first aspect thereof, in which the compound represented by general formula (2) includes a solid content coating amount thereof from 0.3 to 2.4 mmol/$m^2$.

A fourth aspect of the present invention is a thermal recording material subsidiary to the first aspect thereof, in which the compound represented by general formula (3) includes a solid content coating amount thereof from 0.3 to 2.4 mmol/$m^2$.

A fifth aspect of the present invention is a thermal recording material subsidiary to the first aspect thereof, in which the compound represented by general formula (2) includes a proportional amount thereof from 0.1 to 20 mol relative to one mole of the compound represented by general formula (1).

A sixth aspect of the present invention is a thermal recording material subsidiary to the first aspect thereof, in which the compound represented by general formula (3) includes a proportional amount thereof from 0.01 to 10 mol relative to one mole of the compound represented by general formula (2).

A seventh aspect of the present invention is a thermal recording material subsidiary to the first aspect thereof, in which the anion with a valency from 1 to 3 represented by R in general formula (3) includes an anion selected from the group consisting of phenol anions, alcohol anions, mercaptan ions, carboxylate ions, sulfonate ions, thiocarboxylate ions, dithiocarboxylate ions, dithiocarbamate ions, thiocarbonate ions, phosphate ions, monoalkylphosphate ions, dialkylphosphate ions, phosphonate ions acetylacetone ions and salicylate ions.

An eighth aspect of the present invention is a thermal recording material subsidiary to the first aspect thereof, in which M in formula (3) is selected from a group consisting of $Zn^{2+}$, $Fe^{2+}$, $Fe^{3+}$, $Ni^{2+}$ and $Al^{3+}$.

A ninth aspect of the present invention is a thermal recording material subsidiary to the first aspect thereof, in which the compound represented by general formula (1) includes the following diazo compound (C).

Diazo Compound (C):

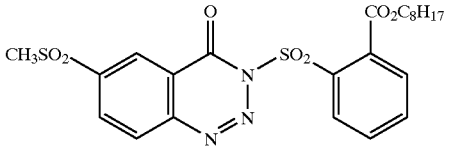

A tenth aspect of the present invention is a thermal recording material subsidiary to the first aspect thereof, in which the compound represented by general formula (2) includes at least one compound selected from the group consisting of the following coupler compound (F), the following coupler compound (G) and the following coupler compound (H).

Coupler Compound (F):

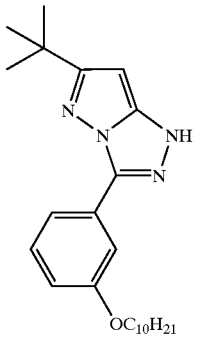

Coupler Compound (G):

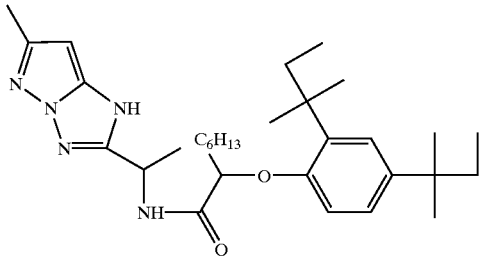

-continued

Coupler Compound (H):

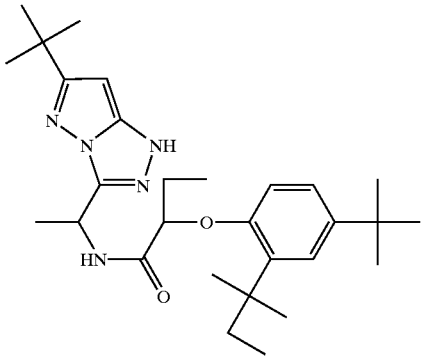

An eleventh aspect of the present invention is a thermal recording material subsidiary to the first aspect thereof, in which the compound represented by general formula (3) includes at least one of the following zinc compounds (A) and (B).

Zinc Compound (A):

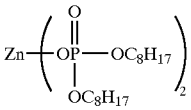

Zinc Compound (B):

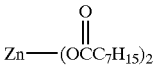

A twelfth aspect of the present invention is a thermal recording material subsidiary to the first aspect thereof, in which at least one of the compounds represented by general formulae (1) to (3) is encapsulated into microcapsules.

A thirteenth aspect of the present invention is a thermal recording material subsidiary to the first aspect thereof, in which the compound represented by the general formula (1) is encapsulated in microcapsules.

A fourteenth aspect of the present invention is a thermal recording material subsidiary to the first aspect thereof, in which the thermal recording layer further includes an organic base.

A fifteenth aspect of the present invention is a thermal recording material subsidiary to the first aspect thereof, in which the thermal recording layer further includes a color-formation promoter.

A sixteenth aspect of the present invention is a thermal recording material subsidiary to the first aspect thereof, in which the thermal recording layer further includes a free radical generator.

DESCRIPTION OF THE PREFERRED EMBODIMENTS

The present invention is described in detail hereinunder. The thermal recording material of the present invention has a thermal recording layer provided on its support, and is characterized in that the thermal recording layer contains a compound of general formula (1), a compound of general formula (2) and a compound of general formula (3) all mentioned below. Containing a specific fixless diazo compound and a specific coupler compound, the thermal recording material of the present invention ensures a satisfactorily high color density; and based on the fixless property of the compound therein, the material is proof against light, its background area is fogged little, and its image storability is good. In addition, the compound of general formula (3) which the material contains further enhances the lightfastness of the image formed on the material.

General Formula (1)

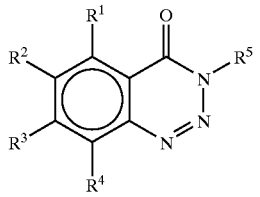

wherein $R^1$, $R^2$, $R^3$ and $R^4$ each independently represent any of a hydrogen atom, a halogen atom, an alkyl group, an aryl group, $—OR^{51}$, $—SR^{51}$, $—COOR^{51}$, $—CONR^{51}R^{52}$, $—SO_2R^{51}$, $—SO_2NR^{51}R^{52}$, $—COR^{51}$, $—NR^{51}R^{52}$, a nitro group and a cyano group; $R^{51}$ and $R^{52}$ each independently represent any of a hydrogen atom, an alkyl group, an aryl group and an acyl group; $R^5$ represents any of a hydrogen atom, an alkyl group, an aryl group, $—COOR^{53}$, $—CONR^{53}R^{54}$, $—SO_2R^{53}$, $—SO_2NR^{53}R^{54}$, and $—COR^{53}$; $R^{53}$ and $R^{54}$ each independently represent any of a hydrogen atom, an alkyl group, an aryl group and an acyl group.

General Formula (2)

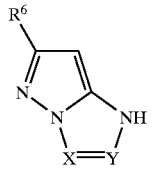

wherein $R^6$ represents an alkyl group or an aryl group; either one of X and Y represents $C—R^7$ and the other represents N; and $R^7$ represents an alkyl group or an aryl group.

$R_n—M_m$ General Formula (3)

wherein R represents a mono to tri-valent anion; M represents a mono to tri-valent metal ion; and n and m each indicate an integer of from 1 to 3.

Compounds of general formula (1) are described. The compound of general formula (1) is a diazo compound that reacts with the compound of general formula (2) to form an azo dye. The compound of general formula (2) is described hereinunder.

In formula (1), $R^1$, $R^2$, $R^3$ and $R^4$ each independently represent any of a hydrogen atom, a halogen atom, an alkyl group, an aryl group, $—OR^{51}$, $—SR^{51}$, $—COOR^{51}$, $—CONR^{51}R^{52}$, $—SO_2R^{51}$, $—SO_2NR^{51}R^{52}$, $—COR^{51}$, $—NR^{51}R^{52}$, a nitro group and a cyano group.

For the halogen atom for $R^1$ to $R^4$, preferred are fluorine, chlorine, bromine and iodine atoms; and more preferred are fluorine and chlorine atoms.

The alkyl group for $R^1$ to $R^4$ includes unsubstituted alkyl groups and substituted alkyl groups, and it may be linear or branched and may have unsaturated bond(s). Preferably, the alkyl group for $R^1$ to $R^4$ has from 1 to 20 carbon atoms, more preferably from 1 to 10 carbon atoms. Concretely, preferable examples thereof include methyl, ethyl, n-propyl, i-propyl, n-butyl, t-butyl, n-hexyl, n-octyl, 2-ethylhexyl, 3,5,5-trimethylhexyl, dodecyl, 2-chloroethyl, 2-methanesulfonylethyl, 2-methoxyethyl, 2-benzoyloxyethyl, N,N-dibutylcarbamoylmethyl, 2-ethoxycarbonylethyl, butoxycarbonylmethyl, 2-isopropyloxyethyl, 2-(2,5-di-t-amylphenoxy)ethyl, 2-phenoxyethyl, 1-(4-methoxyphenoxy)-2-propyl, 1-(2,5-di-t-amylphenoxy)-2-propyl, benzyl, α-methylbenzyl, trichloromethyl, trifluoromethyl and 2,2,2-trifluoroethyl groups.

The aryl group for $R^1$ to $R^4$ includes unsubstituted aryl groups and substituted aryl groups. Preferably, the aryl group for $R^1$ to $R^4$ has from 6 to 30 carbon atoms. Concretely, preferable examples thereof include phenyl, 4-methylphenyl and 2-chlorophenyl groups.

In $R^1$ to $R^4$ each independently indicating any of $—OR^{51}$, $—SR^{51}$, $—COOR^{51}$, $—CONR^{51}R^{52}$, $—SO_2R^{51}$, $—SO_2NR^{51}R^{52}$, $—COR^{51}$ or $—NR^{51}$, $R^{51}$ and $R^{52}$ each independently represent any of a hydrogen atom, an alkyl group, an aryl group and an acyl group.

The alkyl group for $R^{51}$ and $R^{52}$ includes unsubstituted alkyl groups and substituted alkyl groups. Preferably, the alkyl group for $R^{51}$ and $R^{52}$ has from 1 to 30 carbon atoms, more preferably from 1 to 10 carbon atoms. Concretely, preferable examples thereof include methyl, ethyl, i-propyl, s-butyl, t-butyl and t-amyl groups.

The aryl group for $R^{51}$ and $R^{52}$ includes unsubstituted aryl groups and substituted aryl groups. Preferably, the aryl group for $R^{51}$ and $R^{52}$ has from 6 to 30 carbon atoms. Concretely, preferable examples thereof include phenyl, 2-methylphenyl, 3-methylphenyl, 4-methylphenyl, 2-chlorophenyl and 2,5-t-amylphenyl groups.

The acyl group for $R^{51}$ and $R^{52}$ includes unsubstituted acyl groups and substituted acyl groups. Preferably, the acyl group for $R^{51}$ and $R^{52}$ has from 1 to 30 carbon atoms, more preferably from 1 to 10 carbon atoms. Concretely, it includes, for example, acetyl, propanoyl, butanoyl and benzoyl groups.

In formula (1), $R^5$ represents any of a hydrogen atom, an alkyl group, an aryl group, $—COOR^{53}$, $—CONR^{53}R^{54}$, $—SO_2R^{53}$, $—SO_2NR^{53}R^{54}$, and $—COR^{53}$.

The alkyl group for $R^5$ includes unsubstituted alkyl groups and substituted alkyl groups, and it may be linear or branched and may have unsaturated bond(s). Preferably, the alkyl group for $R^5$ has from 1 to 30 carbon atoms. Concretely, preferable examples thereof include methyl, ethyl, n-propyl, i-propyl, n-butyl, i-butyl, 2-butyl, t-butyl, n-hexyl, n-octyl, 2-ethylhexyl, 3,5,5-trimethylhexyl, dodecyl, 2-chloroethyl, 2-methanesulfonylethyl, 2-methoxyethyl, 2-methoxypropyl, 2-benzoyloxyethyl, N,N-dibutylcarbamoylmethyl, 2-ethoxycarbonylethyl, butoxycarbonylmethyl, octyloxycarbonylmethyl, cyclohexyl, 2-isopropyloxyethyl, 2-(2,5-di-t-amylphenoxy) ethyl, 2-phenoxyethyl, 1-(4-methoxyphenoxy)-2-propyl, 1-(2,5-di-t-amylphenoxy)-2-propyl, benzyl, α-methylbenzyl, phenethyl, 3-phenylpropyl, allyl, methallyl, trichloromethyl, trifluoromethyl and 2,2,2-trifluoroethyl groups.

The aryl group for $R^5$ includes unsubstituted aryl groups and substituted aryl groups. Preferably, the aryl group for $R^5$ has from 6 to 30 carbon atoms. Concretely, preferable examples thereof include phenyl, 2-methylphenyl, 3-methylphenyl, 4-methylphenyl, 4-ethylphenyl and 4-isopropylphenyl groups.

In $R^5$ indicating any of $—COOR^{53}$, $—CONR^{53}R^{54}$, $—SO_2R^{53}$, $—SO_2NR^{53}R^{54}$ or $—COR^{53}$, $R^{53}$ and $R^{54}$ each independently represent any of a hydrogen atom, an alkyl group, an aryl group and an acyl group.

The alkyl group for $R^{53}$ and $R^{54}$ includes unsubstituted alkyl groups and substituted alkyl groups. Preferably, the alkyl group for $R^{53}$ and $R^{54}$ has from 1 to 30 carbon atoms, more preferably from 1 to 10 carbon atoms. Concretely, preferable examples thereof include methyl, ethyl, i-propyl, s-butyl, t-butyl and t-amyl groups.

The aryl group for $R^{53}$ and $R^{54}$ includes unsubstituted aryl groups and substituted aryl groups. Preferably, the aryl group for $R^{53}$ and $R^{54}$ has from 6 to 30 carbon atoms. Concretely, preferable examples thereof include phenyl, 2-methylphenyl, 3-methylphenyl, 4-methylphenyl, 2-chlorophenyl and 2,5-t-amylphenyl groups.

The acyl group for $R^{53}$ and $R^{54}$ includes unsubstituted acyl groups and substituted acyl groups. Preferably, the acyl group for $R^{53}$ and $R^{54}$ has from 1 to 30 carbon atoms, more preferably from 1 to 10 carbon atoms. Concretely, it includes, for example, acetyl, propanoyl, butanoyl and benzoyl groups.

Examples of the diazo compounds of general formula (1) are shown below. They are Compounds (A-1) to (A-42), and specific examples indicating the combination of the substituents $R^1$ to $R^5$ in formula (1). To these, however, the diazo compounds for use in the present invention are not limited.

A-1

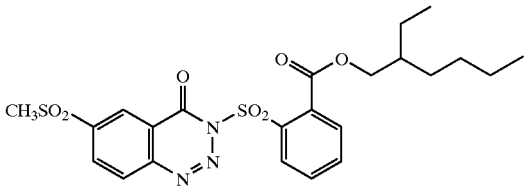

A-2

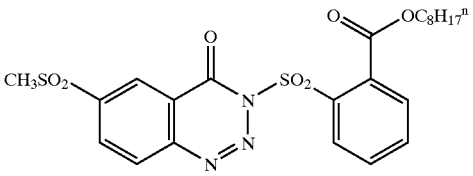

A-3

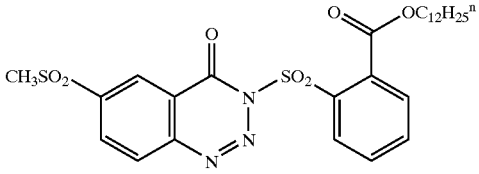

A-4

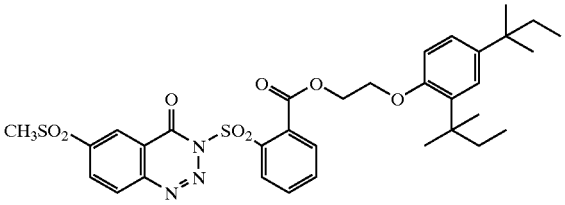

A-5

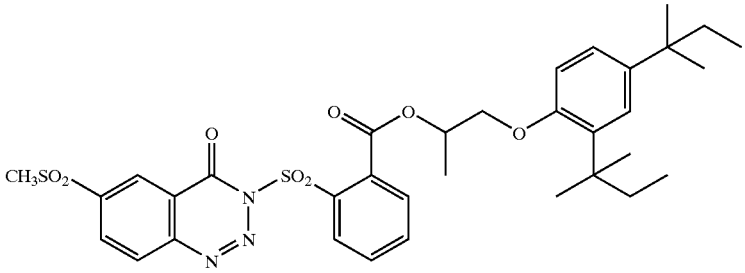

A-6

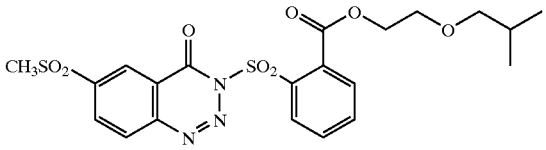

A-7

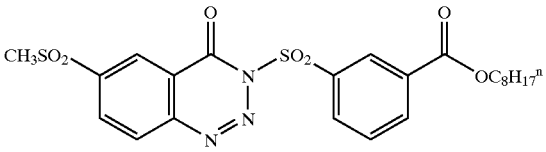

A-8

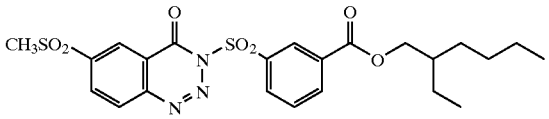

A-9

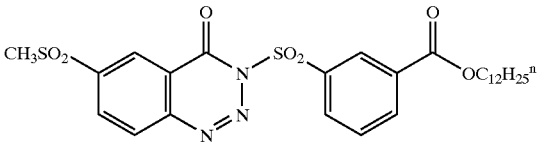

A-10

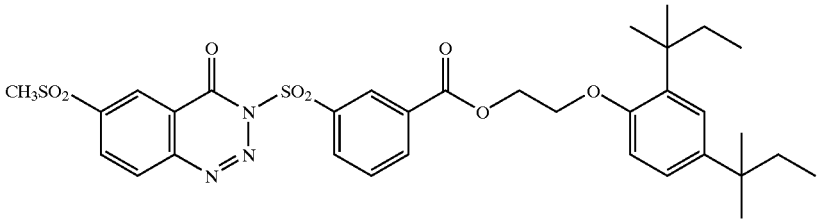

-continued
A-11
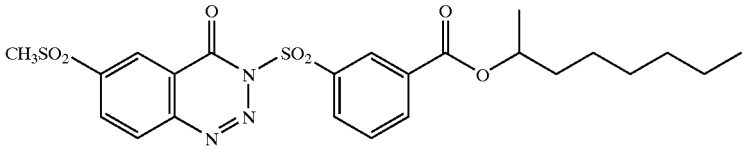
A-12
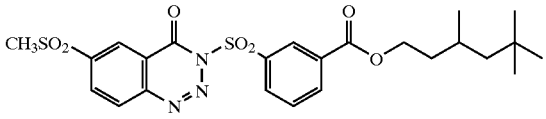
A-13
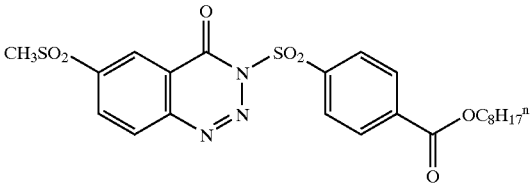
A-14
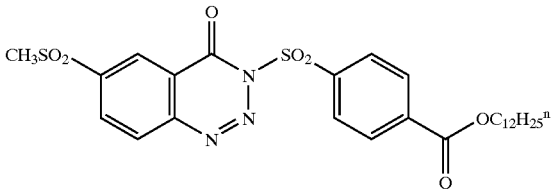
A-15
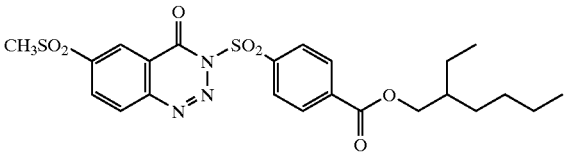
A-16
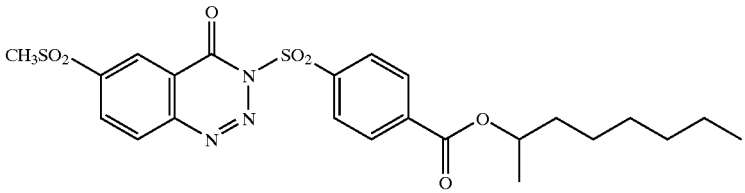
A-17
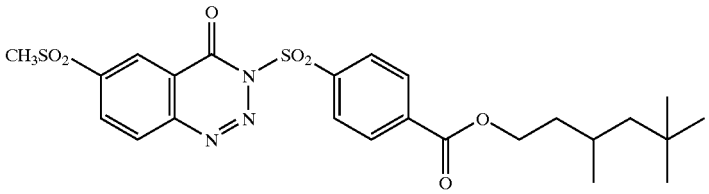
A-18
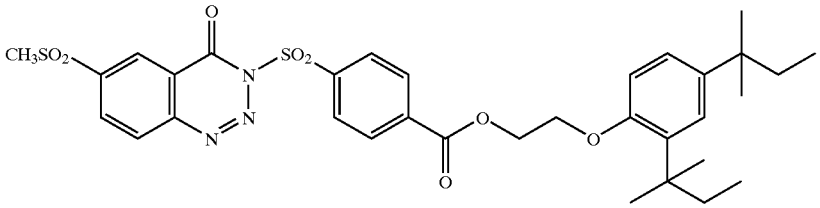
A-19
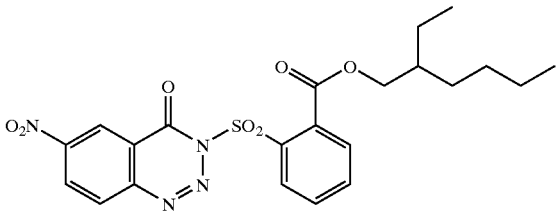
A-20
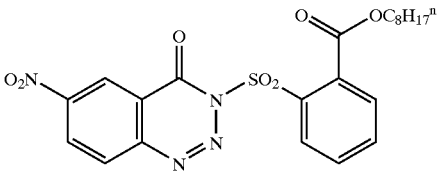
A-21
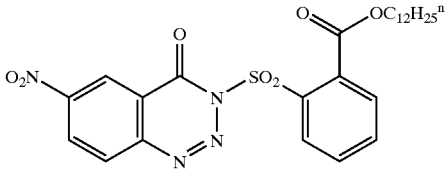

-continued
A-22
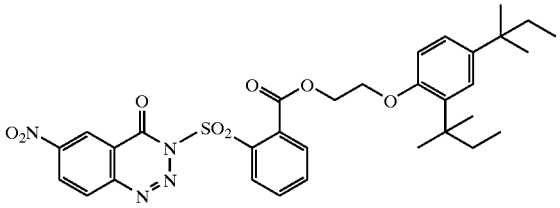
A-23
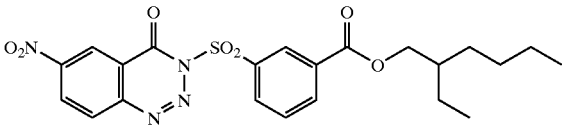
A-24
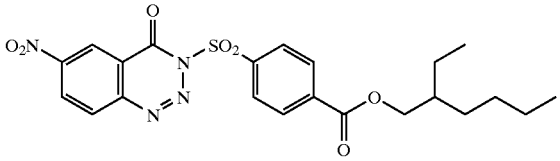
A-25
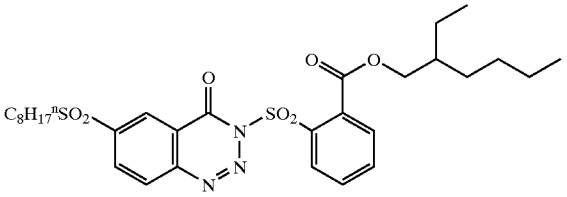
A-26
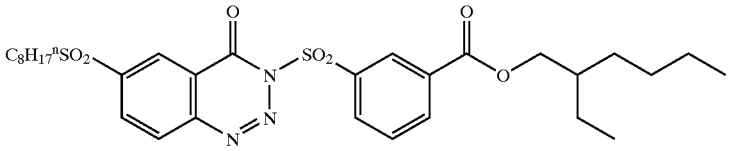
A-27
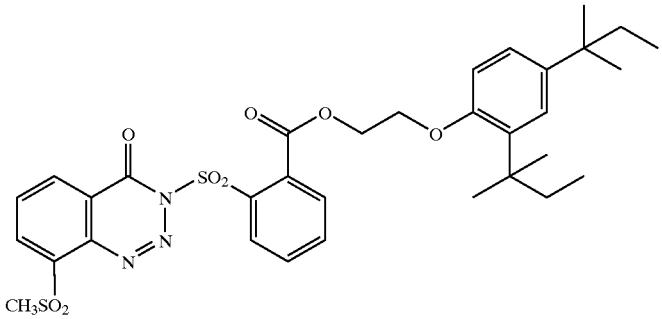
A-28
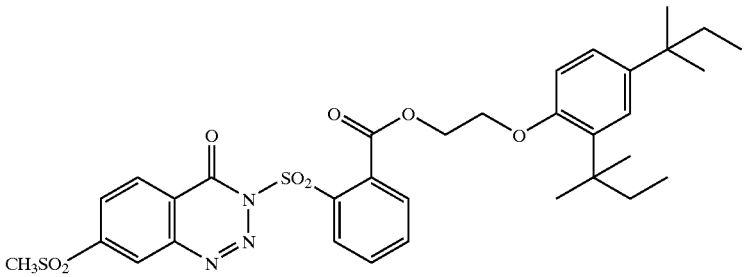
A-29
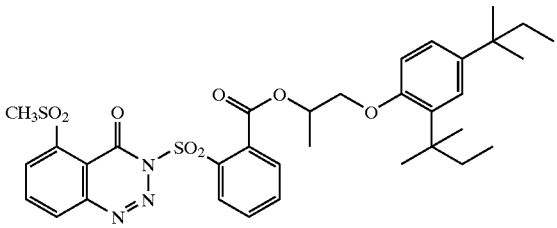
A-30
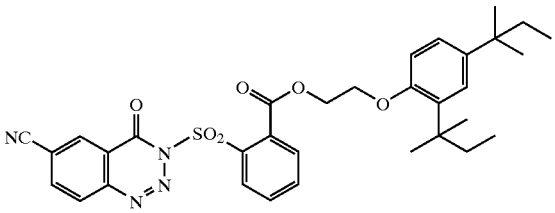

-continued
A-31
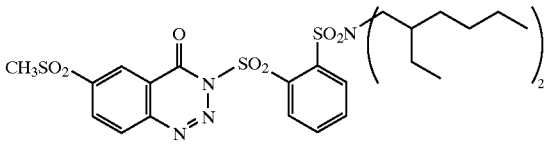
A-32
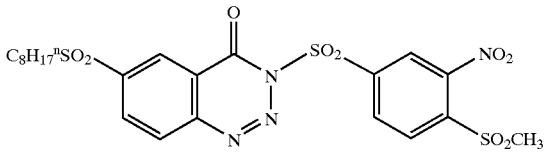
A-33
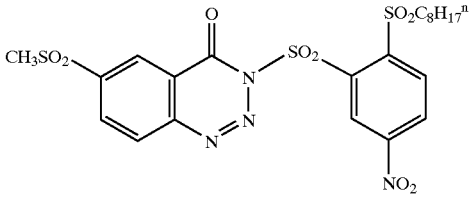
A-34
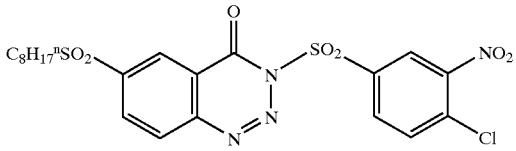
A-35
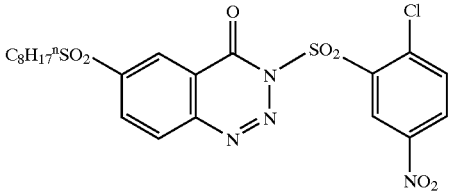
A-36
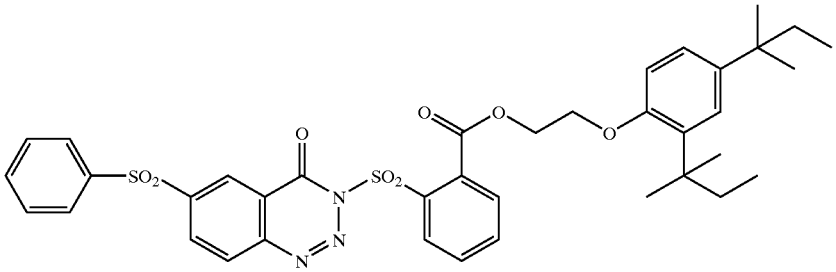
A-37
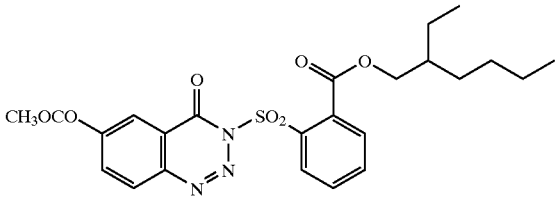
A-38
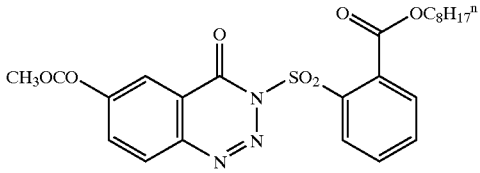
A-39
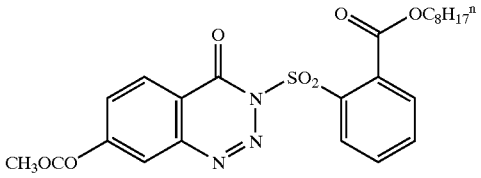
A-40
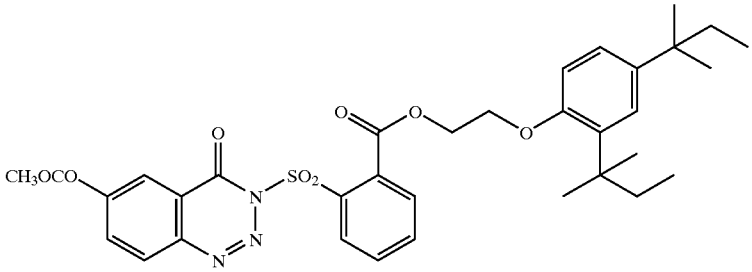

-continued
A-41
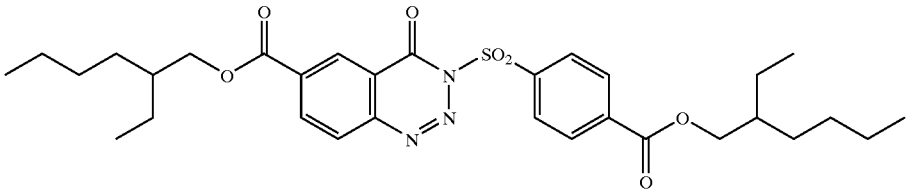
A-42
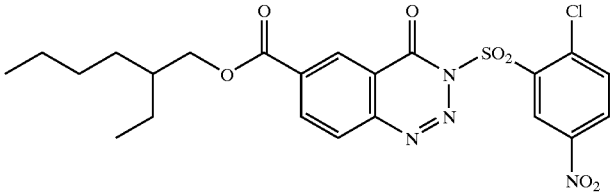
General Formula (I)
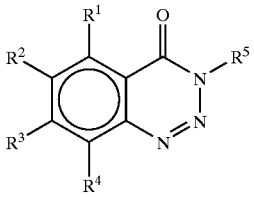
| Examples | $R^1$ | $R^2$ | $R^3$ | $R^4$ | $R^5$ |
|---|---|---|---|---|---|
| 1 | —H | 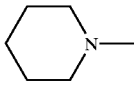 | H— | —H | 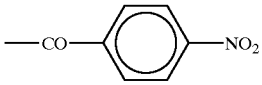 |
| 2 | —H | 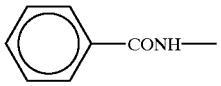 | H— | —H | 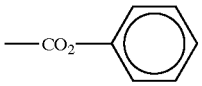 |
| 3 | —H | 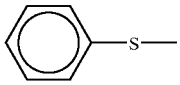 | $C_4H_9O$— | —H | 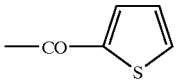 |
| 4 | —H | 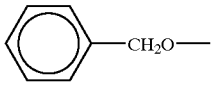 | 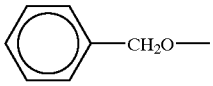 | —H | 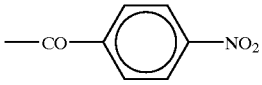 |
| 5 | —H | 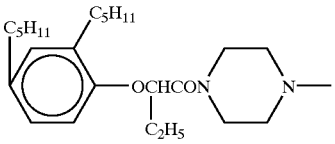 | H— | —H | 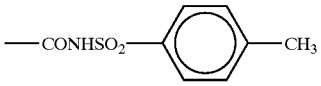 |
| 6 | —H | $C_6H_{13}O$— | $C_6H_{13}O$— | —$OC_6H_{13}$ | 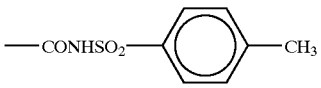 |
| 7 | —H | 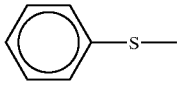 | H— | —H | 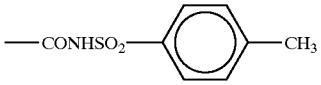 |

-continued
General Formula (I)
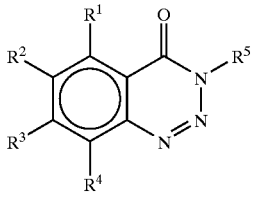
| Examples | $R^1$ | $R^2$ | $R^3$ | $R^4$ | $R^5$ |
|---|---|---|---|---|---|
| 8 | —H | 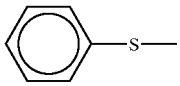 | $C_8H_{17}O$— | —H | 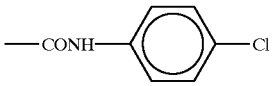 |
| 9 | —H | 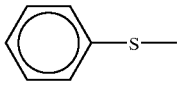 | H— | —H | 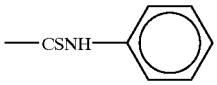 |
| 10 | —H | H— | H— | —H | 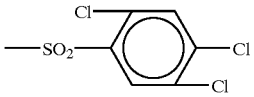 |
| 11 | —H | 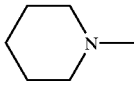 | H— | —H | 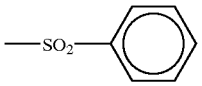 |
| 12 | —H | 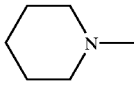 | H— | —H | 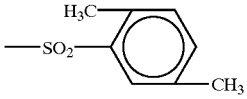 |
| 13 | —H | $(C_8H_{17})_2N$— | H— | —H | —$SO_2CH_3$ |
| 14 | —H | 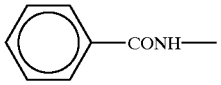 | H— | —H | —$SO_2C_8H_{17}$ |
| 15 | —H | $CH_3CONH$— | H— | —H | 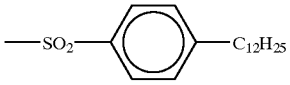 |
| 16 | —H | 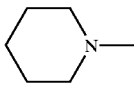 | $C_4H_9O$— | —H | 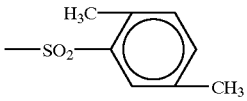 |
| 17 | —H | 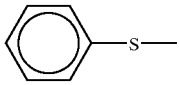 | H— | —H | 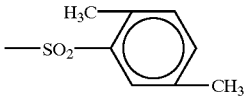 |
| 18 | —H | 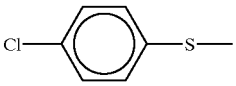 | H— | —H | 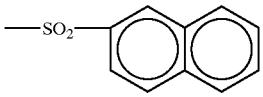 |
| 19 | —H | 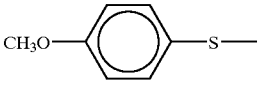 | H— | —H | 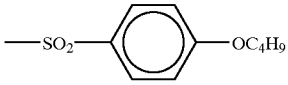 |

-continued

General Formula (I)

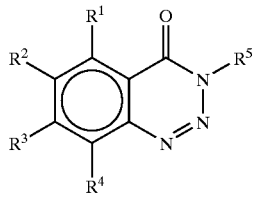

| Examples | $R^1$ | $R^2$ | $R^3$ | $R^4$ | $R^5$ |
|---|---|---|---|---|---|
| 20 | —H | 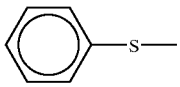 | $C_4H_9O$— | —H | 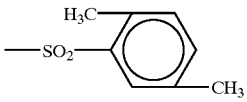 |
| 21 | —H | 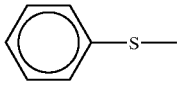 | $CH_2$=$CHCH_2O$— | —H | 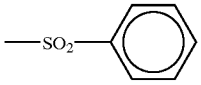 |
| 22 | —H | 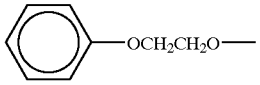 | H— | —H | 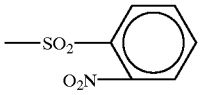 |
| 23 | —H | $C_4H_9O$— | $C_4H_9O$— | —H | 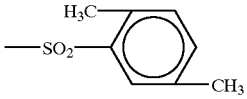 |
| 24 | —H | $C_6H_{13}O$— | $C_6H_{13}O$— | —$OC_6H_{13}$ | 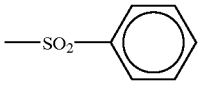 |
| 25 | —H | $C_8H_{17}O$— | H— | —$OC_8H_{17}$ | 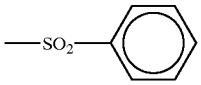 |
| 26 | —H | Cl— | 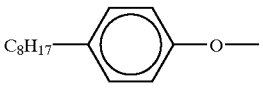 | —H | 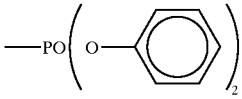 |
| 27 | —H | $C_8H_{17}O$— | $CH_3$— | —$OC_8H_{17}$ | 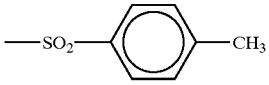 |
| 28 | —$CONH_2$ | H— | $C_{12}H_{25}O$— | —H | 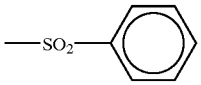 |

The thermal recording layer shall contain at least one diazo compound of general formula (1), and may contain two or more different types of the diazo compounds combined. If desired, any other diazo compound may also be in the layer, combined. Preferably, the amount of the diazo compound of general formula (1) in the thermal recording layer falls between 0.1 and 0.8 mmols/$m^2$, more preferably between 0.2 and 0.6 mmols/$m^2$ in terms of solid content of the coating liquid for the layer. If the content is smaller than 0.1 mmols/$m^2$, it is undesirable since the ability of the compound to form color will be poor; but if larger than 0.8 mmols/$m^2$, it is also undesirable since the coatability of the layer will be poor.

The compound of general formula (2) mentioned below is a coupler compound that reacts with the diazo compound of general formula (1) to form an azo dye. Examples of the compound of general formula (2) are described in JP-A Nos. 2001-219659 and 2001-232948, and any of which are employable herein.

General Formula (2)

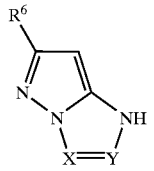

wherein $R^6$ represents an alkyl group or an aryl group; either one of X and Y represents C—$R^7$ and the other represents N; and $R^7$ represents an alkyl group or an aryl group.

Either one of X and Y represents C—$R^7$ and the other represents N. The alkyl group for $R^6$ and $R^7$ may be substituted, preferably having from 1 to 30 carbon atoms in total. Concretely, preferable examples thereof include methyl, ethyl, n-propyl, i-propyl, n-butyl, t-butyl, n-pentyl, n-hexyl, n-heptyl, n-octyl, 3-heptyl, 2-ethylhexyl, 2,4,4-trimethylpentyl, 3,5,5-trimethylhexyl, n-dodecyl, cyclohexyl, benzyl, allyl, 2-chloroethyl, 2-methoxyethyl, 2-ethoxyethyl, 2-phenoxyethyl, 2-(2,5-di-t-amylphenoxy) ethyl, 2-benzoyloxyethyl, methoxycarbonylmethyl, methoxycarbonylethyl, butoxycarbonylethyl and 2-isopropyloxyethyl groups.

The aryl group for $R^6$ and $R^7$ may be substituted, preferably having from 6 to 30 carbon atoms in total. Concretely, preferable examples thereof include phenyl, 4-methylphenyl, 3-methylphenyl, 2-methylphenyl, 4-chlorophenyl, 2-chlorophenyl, 2-ethoxyphenyl, 3-ethoxyphenyl, 4-ethoxyphenyl, 2-decyloxyphenyl, 3-decyloxyphenyl and 4-decyloxyphenyl groups.

Examples of the compounds of general formula (2), Compounds (C-1) to (C-24) are mentioned below, to which, however, the present invention is not limited.

C-1

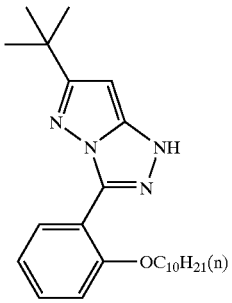

C-2

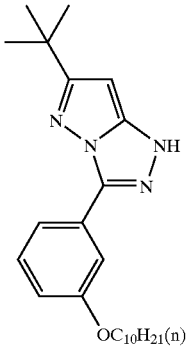

-continued

C-3

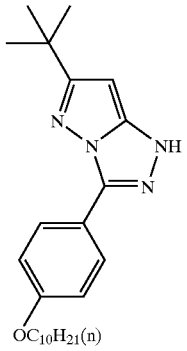

C-4

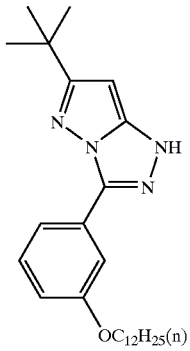

C-5

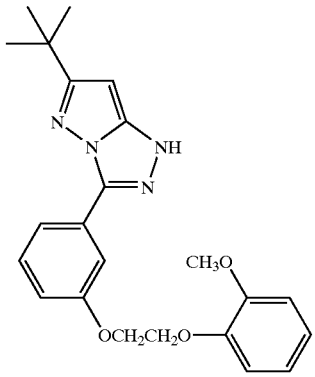

C-6

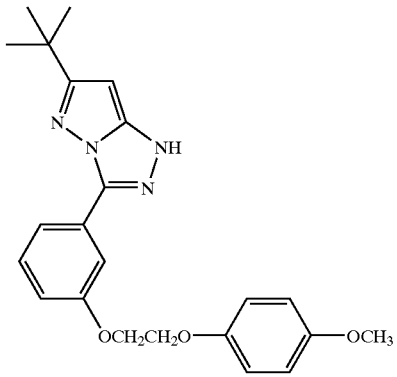

-continued
C-7
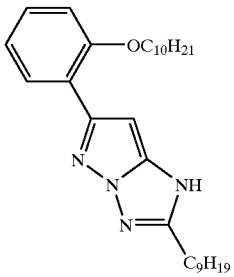
C-8
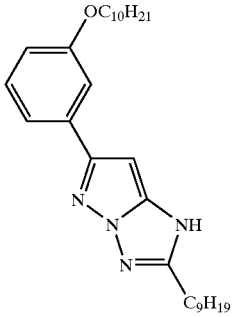
C-9
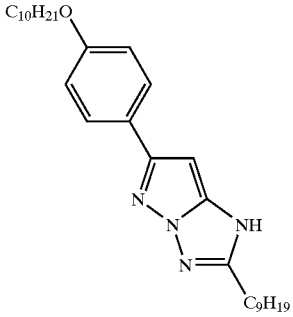
C-10
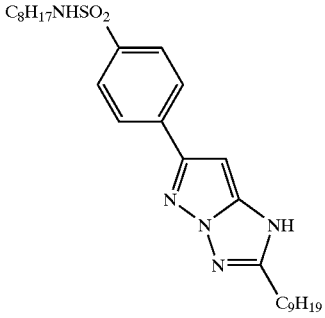
C-11
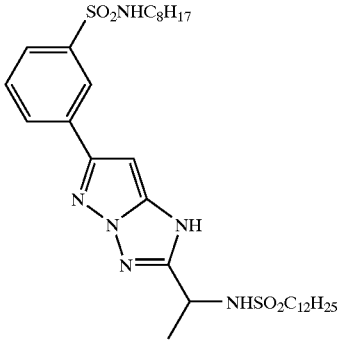
-continued
C-12
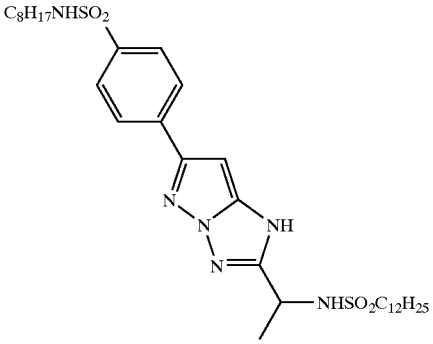
C-13
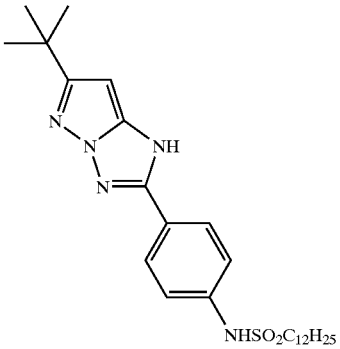
C-14
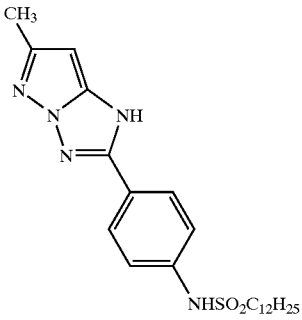
C-15
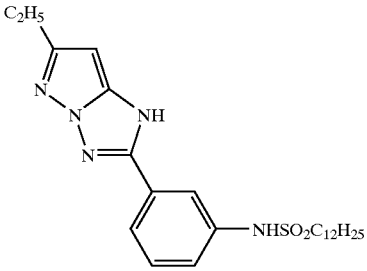

-continued
C-16
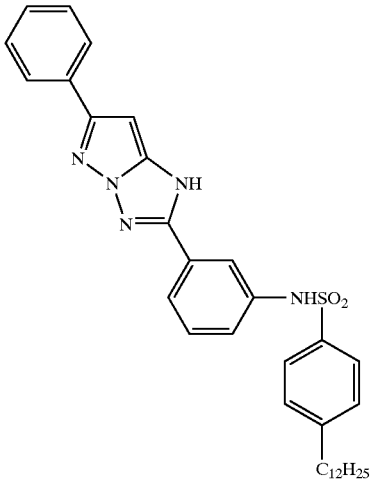
C-17
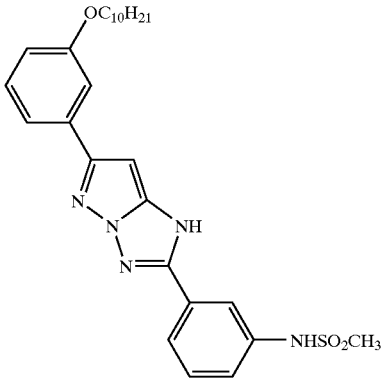
C-18
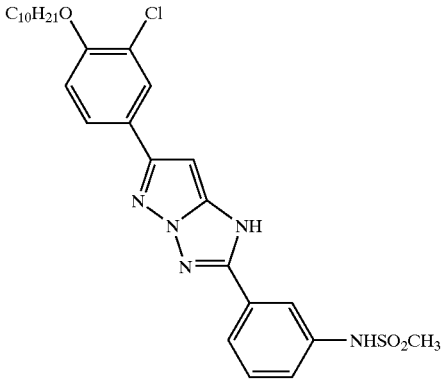
C-19
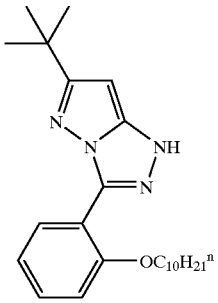
-continued
C-20
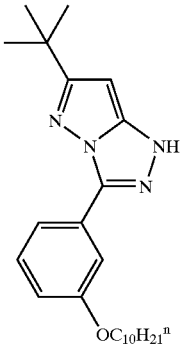
C-21
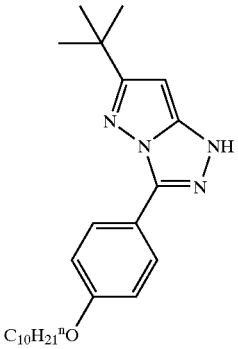
C-22
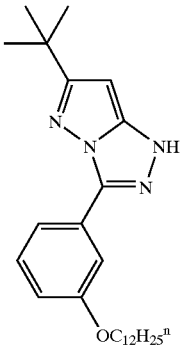
C-23
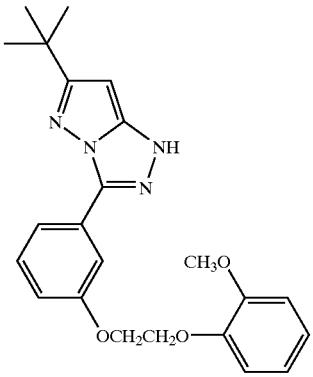

-continued

C-24

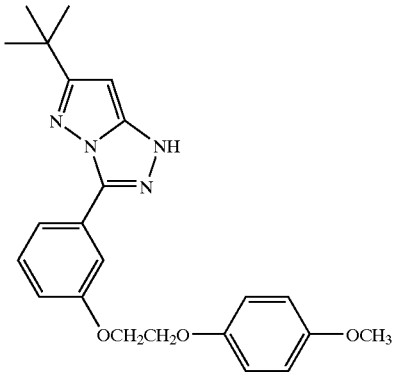

The compounds of general formula (2) are known as magenta coupler compounds for halide-containing photographic materials. For producing the compounds of general formula (2), for example, referred to are the methods described in JP-A Nos. 59-171956, 60-190779,60-197688, 61-145163, 64-6274, 46-43947, 61-18780, 61-251684, 62-33177, 62-249968, 63-101387, 1-233285, 2-115183, 2-201442, 3-220191, 3-258780, 5-222044, 6-25245, 7-179468, 7-278419, 7-295172, and 8-60011.

The thermal recording layer shall contain at least one compound of general formula (2) along with the compound of general formula (1) mentioned above, and may contain two or more different types of the compounds of general formula (2) combined along with the compound of general formula (1). If desired, any other coupler compound may also be in the layer, combined. Preferably, the amount of the compound of general formula (2) in the thermal recording layer falls between 0.3 and 2.4 mmols/$m^2$, more preferably between 0.6 and 1.8 mmols/$m^2$ in terms of its solid content of the coating liquid for the layer. If the content is smaller than 0.3 mmols/$m^2$, it is undesirable since the ability of the compound to form color will be poor; but if larger than 2.4 mmols/$m^2$, it is also undesirable as the amount of the compound is too much.

The compound of general formula (3) mentioned below is an organic metal compound. Containing the organic metal compound of general formula (3) along with the compound of general formula (1) and the compound of general formula (2) in the thermal recording layer therein, the thermal recording material of the present invention ensures improved lightfastness of the image formed thereon. Though not clear, the reason why the lightfastness of the image formed on the material is improved by the compound of general formula (3) will be because the azo dye resulting from the reaction of the diazo compound with the coupler compound in the recording layer may chelate with the compound of general formula (3) therein.

$R_n$—$M_m$ General Formula (3)

wherein R represents a mono to tri-valent anion; M represents a mono to tri-valent metal ion; and n and m each indicate an integer of from 1 to 3.

For the mono to tri-valent anion for R, for example, preferred are phenol anions, alcohol anions, mercaptan ions, carboxylate ions, sulfonate ions, thiocarboxylate ions, dithiocarboxylate ions, dithiocarbamate ions, dithiocarbonate ions, phosphate ions, monoalkylphosphate ions, dialkylphosphate ions, phosphonate ions, acetylacetone ions; and more preferred are phenol anions, carboxylate ions, dithiocarbamate ions, dialkylphosphate ions and salicylate ions.

For the mono to tri-valent metal ion for M, for example, preferred are $Zn^{2+}$, $Fe^{2+}$, $Fe^{3+}$, $Cu^{2+}$, $Co^{2+}$, $Mg^{2+}$, $Ni^{2+}$, $Al^{3+}$; and more preferred are $Zn^{2+}$, $Fe^{2+}$, $Fe^{3+}$, $Ni^{2+}$, $Al^{3+}$.

n and m each are an integer of from 1 to 3, indicating the number of R's and the number of M's, respectively, in formula (3) that are for neutralizing the charge of the compound of general formula (3).

Examples of the compounds of general formula (3), Compounds (3-1) to (3-22) are mentioned below, to which, however, the present invention is not limited.

3-1

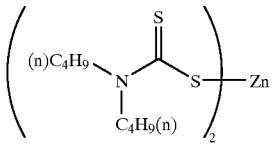

3-2

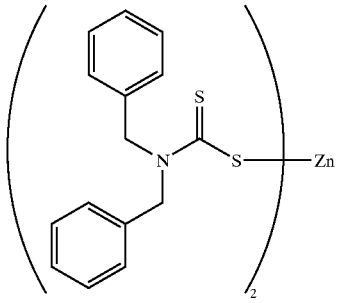

3-3

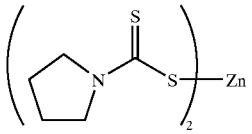

3-4

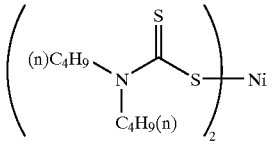

3-5

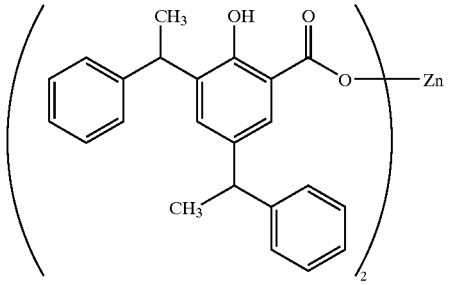

3-6

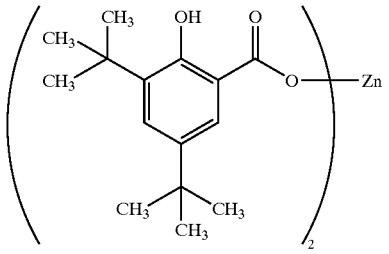

-continued
3-7
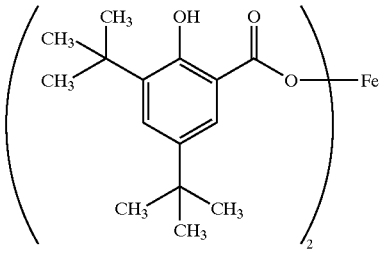
3-8
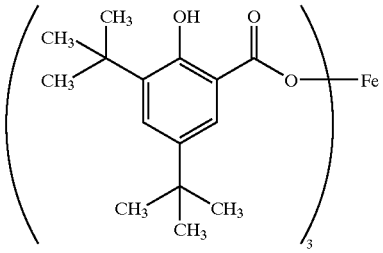
3-9
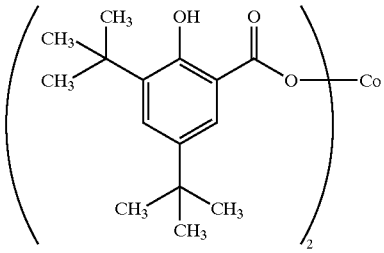
3-10
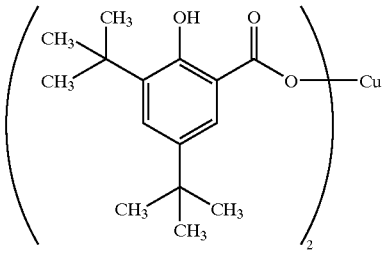
3-11
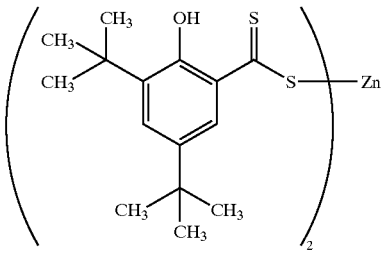
3-12
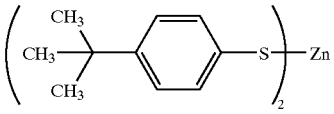
-continued
3-13
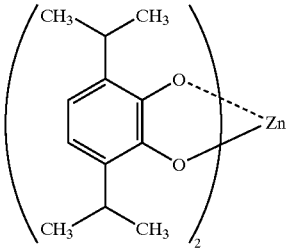
3-14
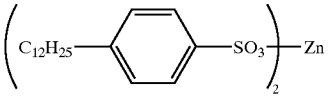
3-15
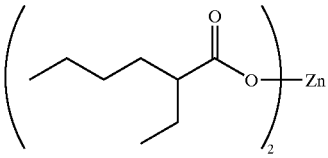
3-16
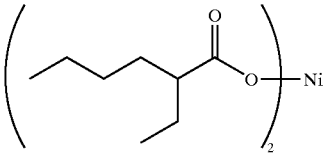
3-17
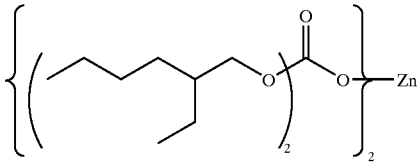
3-18
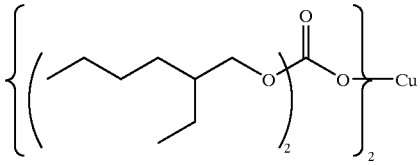
3-19
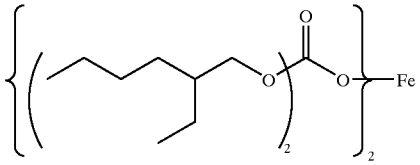
3-20
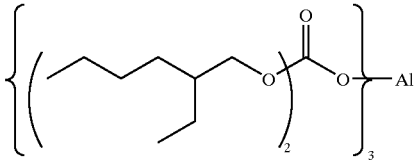
3-21
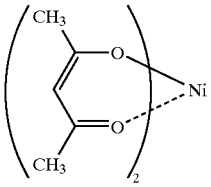

-continued 3-22

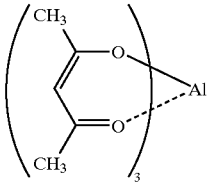

3-23

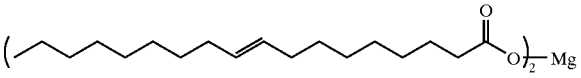

The thermal recording layer shall contain at least one compound of general formula (1) along with the compounds of general formulae (1) and (2) mentioned above, and may contain two or more different types of the compounds of general formula (3) combined along with the compounds of general formulae (1) and (2). Preferably, the amount of the compound of general formula (3) in the thermal recording layer falls between 0.3 and 2.4 mmols/$m^2$, more preferably between 0.6 and 1.8 mmols/$m^2$ in terms of its solid content of the coating liquid for the layer. If the content is smaller than 0.3 mmols/$m^2$, it is undesirable since the lightfastness of the material will be poor; but if larger than 2.4 mmols/$m^2$, it is also undesirable as the amount of the compound is too much.

In the thermal recording material of the present invention, at least one compound of general formulae (1) to (3) is preferably encapsulated in microcapsules for further enhancing the raw-stock storability and the image storability of the material and for ensuring long-term whiteness of the background area of the material. More preferably, the diazo compound of general formula (1) is encapsulated as the core in microcapsules to be in the material. For forming such microcapsules, employable are any known methods. The polymer substance to form the microcapsule walls must be impervious at room temperature and must become pervious when heated, and its glass transition point preferably falls between 60 and 200° C. Its examples are polyurethanes, polyureas, polyamides, polyesters, urea-formaldehyde resins, melamine resins, polystyrenes, styrene-methacrylate copolymers, styrene-acrylate copolymers and their mixtures.

For forming the microcapsules, suitable is interfacial polymerization or internal polymerization. The details of the methods and the reactants to be used are described in U.S. Pat. Nos. 3,726,804 and 3,796,669. For example, in cases where polyureas or polyurethanes are used for the microcapsule walls, a polyisocyanate and a second substance that reacts with it to form microcapsule walls (e.g., polyols, polyamines) are mixed in an aqueous medium or an oily medium to be encapsulated, and these are emulsified and dispersed in water and then heated therein to lead to polymerization around the resulting oil drops to form the intended microcapsule walls around them. In this process, even when the second substance is omitted, polyureas can be formed.

In the present invention, the polymer substance to form the microcapsule walls is preferably at least one selected from polyurethanes and polyureas.

A method for forming microcapsules (polyurea-polyurethane walls) that contain the diazo compound of the present invention is described below.

First, a diazo compound of general formula (1) is dissolved or dispersed in a high-boiling-point solvent to prepare an oily phase which is to be the core of microcapsules. In the present invention, the ratio of the high-boiling-point solvent to be used preferably falls between 0.25 to 10 parts by weight to one part by weight of the diazo compound, more preferably between 0.5 and 5 parts by weight thereto. If it is smaller than 0.25 parts by weight, the background fogging of the material will increase; but if larger than 10 parts by weight, the color density of the material could not increase to a satisfactory degree. In the step of preparing the oily phase, a polyisocyanate serving as a wall material is added to the reaction system.

The high-boiling-point solvent includes, for example, alkylbiphenyls, alkylnaphthalenes, alkyldiphenylethanes, alkyldiphenylmethanes, chloroparaffins, tricresyl phosphate, maleates, adipates, and phthalates. Two or more of these may be used, combined.

In preparing the oily phase, in general, the diazo compound is dissolved in such a high-boiling-point solvent, but if its solubility in the solvent is low, a low-boiling-point solvent (having a boiling point of not higher than 100° C.) in which the solubility of the diazo compound is high may be used as an auxiliary solvent. The low-boiling-point solvent includes, for example, ethyl acetate, butyl acetate, methylene chloride, tetrahydrofuran, and acetone. The low-boiling-point, if used, evaporates during the process of encapsulation and does not remain in the finished microcapsules. Therefore, there is no limitation on its amount to be used.

Accordingly, it is desirable that the diazo compound of general formula (1) is soluble in some degree in those low-boiling-point solvents and high-boiling-point solvents. Concretely, it is desirable that the solubility of the compound in those solvents is at least 5% but the solubility thereof in water is at most 1%.

On the other hand, an aqueous solution is prepared by dissolving a water-soluble polymer in water. To the thus-prepared aqueous phase, added is the oily phase, and this is emulsified and dispersed by the use of a homogenizer or the like. In this, the water-soluble polymer serves as a dispersion medium that facilitates uniform dispersion and stabilizes the resulting aqueous emulsion. For further facilitating uniform dispersion and stabilizing the aqueous emulsion, a surfactant may be added to at least one of the oily phase or the aqueous phase. The surfactant for that purpose may be any known one generally employed for emulsification in the art. The amount of the surfactant, if used, preferably falls between 0.1% and 5%, more preferably between 0.5% and 2% by weight of the oily phase.

Regarding the solubility in water of the water-soluble polymer to form the aqueous solution for the emulsion, it is desirable that the polymer is soluble in water at a temperature at which the oily phase is emulsified to a degree of at least 5%. Examples of the water-soluble polymer of this type are polyvinyl alcohol and its modified derivatives, polyacrylamide and its derivatives, ethylene-vinyl acetate copolymers, styrene-maleic anhydride copolymers, ethylene-maleic anhydride copolymers, isobutylene-maleic anhydride copolymers, polyvinylpyrrolidone, ethylene-acrylic acid copolymers, vinyl acetate-acrylic acid copolymers, carboxymethyl cellulose, methyl cellulose, casein, gelatin, starch derivatives, gum arabic, and sodium alginate.

Preferably, these water-soluble polymers have no or little reactivity with isocyanate compounds that are used for forming microcapsule walls. Therefore, for example, gelatin and others having a reactive amino group in the molecular chain must be pre-modified so as to make them inactive.

For the polyisocyanate compounds for use herein, preferred are those having a trifunctional or more polyfunctional isocyanate group, but such polyisocyanate compounds may be combined with difunctional isocyanate compounds. Concretely, they include, for example, dimers or trimers (biurets or isocyanurates) comprising essentially of diisocyanates such as xylylene diisocyanate and its hydrogenates, hexamethylene diisocyanate, tolylene diisocyanate and its hydrogenates, isophorone diisocyanate; as well as polyfunctional adducts with polyols such as trimethylolpropane, and formalin condensates with benzene isocyanate.

The amount of the polyisocyanate to be used herein is so defined that the mean particle size of the microcapsules formed could fall between 0.3 and 12 μm and the wall thickness thereof could fall between 0.01 and 0.3 μm. The particle size of the dispersed microcapsules generally falls between 0.2 and 10 μm or so. In the emulsified dispersion, the polyisocyanate polymerizes in the interface between the oily phase and the aqueous phase to form a polyurea wall.

Also if desired, still another ingredient selected from polyols or polyamines may be added to the aqueous phase or to the hydrophobic solvent, and it will react with the polyisocyanate to assist the formation of the microcapsule walls. In the reaction to form the microcapsule walls, it is desirable to elevate the reaction temperature or to add a suitable polymerization catalyst to the system for accelerating the reaction speed.

Examples of the polyols and polyamines are propylene glycol, glycerin, trimethylolpropane, triethanolamine, sorbitol, and hexamethylenediamine. When a polyol is added to the reaction system, then a polyurethane wall is formed.

The polyisocyanates, the polyols, the reaction catalysts, and also the polyamines that partly assist the wall formation are described in detail in some references (e.g., Keiji Iwata's *Polyurethane Handbook*, Nikkan Kogyo Shinbun-sha, 1987).

Emulsifying the components may be effected in any known emulsifying device, such as homogenizer, Manton Gaulin, ultrasonic disperser, dissolver or Keddy mill. After having been thus emulsified, the resulting emulsion is kept heated at 30 to 70° C. for promoting its capsule wall formation. During the reaction, cohesion of microcapsules being formed must be prevented. For this, water will be added to the reaction system to lower the probability of collision of microcapsules with each other; or the system will be fully stirred.

As the case may be, an additional dispersion may be added to the reaction system to prevent cohesion of microcapsules. With the progress of polymerization, carbon dioxide is formed. The time at which the formation of carbon dioxide is terminated will be nearly the end point of the microcapsule wall formation. In general, the intended, diazo compound-containing microcapsules can be formed within a few hours after the start of the reaction.

On the other hand, the coupler compound of general formula (2) and the compound of general formula (3) may be dispersed in solid, for example, along with a water-soluble polymer and an organic base and optionally any other color-formation promoter, in a sand mill or the like. Especially preferably, these are first dissolved in a hardly water-soluble or water-insoluble, high-boiling-point organic solvent, the resulting solution is then mixed with an aqueous polymer solution (aqueous phase) that contains a surfactant and/or a water-soluble polymer serving as a protective colloid, and the resulting mixture is emulsified in a homogenizer or the like. The thus-prepared emulsion is preferred for use herein. In this case, if desired, a low-boiling-point solvent serving as a dissolution promoter may be used. Apart from the case, the coupling component and the organic base may be separately emulsified and dispersed to form different emulsions that shall be combined later into one; or they may be first mixed, then dissolved in a high-boiling-point solvent, and thereafter emulsified and dispersed to form an emulsion. Preferably, the particle size of the emulsion is at most 1 μm.

The organic solvent to be used herein may be suitably selected, for example, from the high-boiling-point oil compounds described in JP-A No. 2-141279.

Of those, esters are preferred in view of the stability of the emulsions formed. More preferred is tricresyl phosphate. Two or more different types of the oil compounds mentioned above may be combined, or they may be further combined with any other oil.

If desired, a low-boiling-point solvent serving as an auxiliary solvent may be added to the above-mentioned organic solvent. Especially preferred for the auxiliary solvent are, for example, ethyl acetate, isopropyl acetate, butyl acetate and methylene chloride. As the case may be, such an auxiliary, low-boiling-point solvent may be used alone, not combined with the high-boiling-point oil.

A water-soluble polymer serving as a protective colloid may be in the aqueous phase to be mixed with the oily phase as above. It may be suitably selected from any known anionic polymers, nonionic polymers, and ampholytic polymers. Preferred for the water-soluble polymer for use herein are, for example, polyvinyl alcohol, gelatin, and cellulose derivatives.

The surfactant that may also be in the aqueous phase may be suitably selected from anionic or nonionic surfactants not reacting with the protective colloid therein to cause solid deposition or coagulation. Preferred for the surfactant for use herein are sodium alkylbenzenesulfonates, sodium alkylsulfates, sodium dioctyl sulfosuccinate, and polyalkylene glycols (e.g., polyoxyethylene nonylphenyl ether).

The amount of the coupler compound of general formula (2) to be in the thermal recording material of the present invention preferably falls between 0.1 and 20 mols, more preferably between 1 and 5 mols, relative to 1 mol of the diazo compound of general formula (1) therein. If the amount of the coupler compound to be in the material is too small, the ability of the material to form color will be poor; but if too large, the coatability of the coating liquid will be poor.

The amount of the compound of general formula (3) to be in the material preferably falls between 0.01 and 10 mols, more preferably between 0.5 and 2 mols, relative to 1 mol of the coupler compound of general formula (2) therein. If the amount of the coupler compound of general formula (3) to be in the material is too small, the lightfastness of the material will be poor; but if too large, the compound will be difficult to emulsify and the coatability of the coating liquid will be poor.

Preferably, an organic base is added to the thermal recording material of the present invention for the purpose of promoting the coupling reaction of the diazo compound and the coupling component in the material. One or more different types of organic bases may be used therein either singly or combined. The organic base includes, for example, nitrogen-containing compounds such as tertiary amines, piperidines, piperazines, amidines, formamidines, pyridines, guanidines, and morpholines. Also employable herein are those described in Japanese Patent Application Bulletin (JP-B) No. 52-46806; JP-A Nos. 62-70082, 57-169745, 60-94381, 57-123086, 58-134901, and 60-49991; JP-B Nos. 2-24916 and 2-28479; and JP-A Nos. 60-165288, 57-185430, and 8-324129.

Of those, especially preferred for use herein are piperazines such as N,N'-bis(3-phenoxy-2-hydroxypropyl) piperazine, N,N'-bis[3-(p-methylphenoxy)-2-hydroxypropyl]piperazine, N,N'-bis[3-(p-methoxyphenoxy)-2-hydroxypropyl]piperazine, N,N'-bis(3-phenylthio-2-hydroxypropyl)piperazine, N,N'-bis[3-(β-naphthoxy)-2-hydroxypropyl]piperazine, N-3-(β-naphthoxy)-2-hydroxypropyl-N'-methylpiperazine, 1,4-bis{[3-(N-methylpiperazino)-2-hydroxy]propyloxy}benzene; morpholines such as N-[3-(β-naphthoxy)-2-hydroxy] propylmorpholine, 1,4-bis(3-morpholino-2-hydroxypropyloxy)benzene, 1,3-bis(3-morpholino-2-hydroxypropyloxy)benzene; piperidines such as N-(3-phenoxy-2-hydroxypropyl)piperidine, N-dodecylpiperidine; and guanidines such as triphenylguanidine, tricyclohexylguanidine, dicyclohexylphenylguanidine.

In the thermal recording material of the present invention, the amount of the organic base to be used preferably falls between 0.1 and 10 mols, relative to 1 mol of the diazo compound of general formula (1) therein.

In addition to the organic base mentioned above, the thermal recording material of the present invention may further contain a color-formation promoter for promoting the color-forming reaction in the material.

The color-formation promoter has the property of increasing the color density of the material recorded under heat or lowering the lowermost color-forming temperature of the material. Concretely, it acts to lower the melting point of the coupler compound, the organic base or the diazo compound that is to be in the thermal recording material of the present invention, or acts to lower the softening point of the walls of the microcapsules to be in the material, thereby facilitating the reaction of the diazo compound with the coupling component in the material.

The color-formation promoter usable in the thermal recording material of the present invention includes, for example, phenol derivatives, naphthol derivatives, alkoxy-substituted benzenes, alkoxy-substituted naphthalenes, aromatic ethers, thioethers, esters, amides, ureides, urethanes, sulfonamide compounds and hydroxy compounds; and it may be in the thermal recording layer of the material to ensure rapid and complete color formation in the layer at low energy.

The color-formation promoter encompasses thermal fusing substances which are solid at room temperature but melt under heat and which have a melting point falling between 50° C. and 150° C. The substances dissolve the diazo compound, the coupling component or the organic base in the thermal recording material of the present invention. Concretely, for example, they are carbonamides, N-substituted carbonamides, ketone compounds, urea compounds, and esters.

The thermal recording material of the present invention preferably contains a known antioxidant such as those mentioned below, for further improving the fastness to light and heat of the images recorded thereon and for preventing as much as possible the non-image area of the material from being yellowed by light.

Antioxidants usable for the purpose are described in, for example, EP-A 223,739, 309,401, 309,402, 310,551, 310, 552, 459,416; German Patent Application Publication No. 3,435,443; JP-A Nos. 54-48535, 62-262047, 63-113536, 63-163351, 2-262654, 2-71262, 3-121449, 5-61166, and 5-119449; and U.S. Pat. No. 4,814,262 and 4,980,275.

In addition, for preventing the thermal recording material of the present invention from being aged through oxidation, various additives known in the art of thermal recording materials and pressure-sensitive recording materials are effective. Examples of the additives are described in, for example, JP-A Nos. 60-107384, 60-107383, 60-125470, 60-125471, 60-125472, 60-287485, 60-287486, 60-287487, 60-287488, 61-160287, 61-185483, 61-211079, 62-146678, 62-146680, 62-146679, 62-282885, 63-051174, 63-89877, 63-88380, 63-088381, 63-203372, 63-224989, 63-251282, 63-267594, 63-182484, 1-239282, 4-291685, 4-291684, 5-188687, 5-188686, 5-110490 and 5-170361; and JP-B Nos. 48-043294 and 48-033212.

Concretely mentioned for them are 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanoate, 2,2-bis(4-hydroxyphenyl)propane, 1,1-bis(4-hydroxyphenyl)-2-ethylhexane, 2-methyl-4-methoxydiphenylamine, 1-methyl-2-phenylindole.

Preferably, the amount of the antioxidant that may be in the thermal recording material of the present invention falls between 0.05 and 100 parts by weight, more preferably between 0.2 and 30 parts by weight, relative to 1 part by weight of the diazo compound of general formula (1) therein.

The known antioxidant may be in microcapsules along with the diazo compound therein, or may form a solid dispersion along with the coupling component, the organic base and the other color-formation promoter therein, or may form an emulsion along with a suitable emulsification promoter therein, or may even be in any form of their combinations. Not only one but also two or more different types of the antioxidants may be used herein either singly or combined. If desired, the antioxidant may be in the protective layer optionally formed on the thermal recording layer of the material of the present invention.

The antioxidant need not be in just one layer of the material. In cases where two or more different types of antioxidants are combined for use herein, they may be grouped into anilines, alkoxybenzenes, hindered phenols, hindered amines, hydroquinone derivatives, phosphorus compounds and sulfur compounds with respect to their structures, and two or more of them that differ from each other in point of their structures may be combined; or two or more of them of the same type may be combined.

The thermal recording material of the present invention may further contain a free radical generator generally used in photopolymerizable compositions (this is a compound that generates a free radical through exposure to light), for the purpose of preventing the background area of the recorded material from being yellowed. The free radical generator includes, for example, aromatic ketones, quinones, benzoins, benzoin ethers, azo compounds, organic disulfides, and acyloxime esters. The amount of the free radical generator that may be added to the material preferably falls between 0.01 and 5 parts by weight relative to 1 part by weight of the diazo compound of general formula (1) in the material.

Also for preventing its yellowing, the material may contain an ethylenic unsaturated bond-having polymerizable compound (hereinafter referred to as vinyl monomer). The vinyl monomer is a compound having at least one ethylenic unsaturated bond (e.g., vinyl group, vinylidene group) in the chemical structure, and may be in any chemical form of monomers or prepolymers. Its examples are unsaturated carboxylic acids and their salts, esters of unsaturated carboxylic acids with aliphatic polyalcohols, and amides of unsaturated carboxylic acids with aliphatic polyamine compounds. The amount of the vinyl monomer that may be in the material may fall between 0.2 and 20 parts by weight relative to 1 part by weight of the diazo compound of general formula (1) therein.

The free radical generator and the vinyl monomer may be in microcapsules along with the diazo compound therein.

In addition to the components mentioned above, the thermal recording material of the present invention may further contain any of citric acid, tartaric acid, oxalic acid, boric acid, phosphoric acid or pyrophosphoric acid serving as an acid stabilizer.

The thermal recording material of the present invention may be fabricated, for example, as follows: A coating liquid that contains a diazo compound of general formula (1) in microcapsules, a coupler compound of general formula (2), a compound of general formula (3), an organic base and other additives is prepared, and this is applied onto a support of, for example, paper or synthetic resin film in a mode of bar coating, blade coating, air-knife coating, gravure coating, roll coating, spraying, dipping, curtain coating or the like, and dried to form thereon a thermal recording layer having a solid content of from 2.5 to 30 g/m$^2$. In this, the final amount of the basic compound generally falls between 0.5 and 5 molar times the diazo compound therein, though varying depending on the strength of the basic compound.

In the thermal recording material of the present invention, the microcapsules, the coupler compound, the compound of general formula (3) and the organic base may be in one and the same layer, but may be in different layers that form a laminate structure. If desired, an interlayer may be formed on the support, as in JP-A No. 61-54980, and the thermal recording layer may be formed thereon.

A binder may be used in the thermal recording material of the present invention. It may be any known water-soluble polymer compound or latex. The water-soluble polymer compound includes, for example, methyl cellulose, carboxymethyl cellulose, hydroxyethyl cellulose, hydroxypropyl cellulose, starch derivatives, casein, gum arabic, gelatin, ethylene-maleic anhydride copolymer, styrene-maleic anhydride copolymer, polyvinyl alcohol, epichlorohydrin-modified polyamide, isobutylene-maleic anhydride-salicylic acid copolymer, polyacrylic acid, polyacrylamide, and their modified derivatives. The latex includes, for example, styrene-butadiene rubber latex, methyl acrylate-butadiene rubber latex, and vinyl acetate emulsion.

The thermal recording material of the present invention may contain any known organic and inorganic pigments. Concretely, it may contain any of kaolin, calcined kaolin, talc, agalmatolite, diatomaceous earth, calcium carbonate, aluminium hydroxide, magnesium hydroxide, zinc oxide, lithopone, amorphous silica, colloidal silica, calcined gypsum, silica, magnesium carbonate, titanium oxide, alumina, barium carbonate, barium sulfate, mica, microballoons, urea-formalin filler, polyester particles, and cellulose filler.

The thermal recording material of the present invention may further contain, if desired, other various additives such as wax, antistatic agent, defoaming agent, electroconductive agent, fluorescent dye, surfactant, UV absorbent and its precursors. These are known in the art.

Also if desired, the thermal recording material of the present invention may have a protective layer on the thermal recording layer. The protective layer may have a laminate structure of two or more layers, if desired. For the material to form the protective layer, herein usable are water-soluble polymer compounds such as polyvinyl alcohol, carboxy-modified polyvinyl alcohol, vinyl acetate-acrylamide copolymer, silicon-modified polyvinyl alcohol, starch, modified starch, methyl cellulose, carboxymethyl cellulose, hydroxymethyl cellulose, gelatins, gum arabic, casein, hydrolyzed styrene-maleic acid copolymer, hydrolyzed styrene-maleic acid copolymer half-ester, hydrolyzed isobutylene-maleic anhydride copolymer, polyacrylamide derivatives, polyvinyl pyrrolidone, sodium polystyrenesulfonate, sodium alginate; and latexes such as styrene-butadiene rubber latex, acrylonitrile-butadiene rubber latex, methyl acrylate-butadiene rubber latex, vinyl acetate emulsion. If desired, the water-soluble polymer compound to form the protective layer may be crosslinked for further improving the storage stability of the recording material. For this, any known crosslinking agent may be used. Concretely, usable for it are water-soluble precondensates such as N-methylolurea, N-methylolmelamine, urea-formalin; dialdehyde compounds such as glyoxal, glutaraldehyde; inorganic crosslinking agents such as boric acid, borax; and polyamidepichlorohydrin. If desired, the protective layer may contain any known pigment, metal soap, wax and surfactant. The amount of the protective layer to be formed preferably falls between 0.2 and 5 g/m$^2$, more preferably between 0.5 and 2 g/m$^2$, and the thickness thereof preferably falls between 0.2 and 5 $\mu$m, more preferably between 0.5 and 2 $\mu$m.

For the support of the thermal recording material of the present invention, usable is any and every type of paper support generally used for conventional pressure-sensitive or thermal copying paper or dry or wet diazo copying paper. Concretely, the support includes, for example, acid paper, neutral paper, coated paper, plastic film-laminated paper such as that laminated with polyethylene, synthetic paper, and plastic films such as polyethylene terephthalate or polyethylene naphthalate films. If desired, the thermal recording material of the present invention may have a back-coat layer for correcting the curl balance of the support thereof and for preventing chemicals and others from penetrating into the back surface thereof. The back-coat layer may be formed in the same manner as that for forming the protective layer. In addition, a release sheet may be attached to the back surface of the material via an adhesive layer therebetween. With that, the recording material may be used as labels.

Having a laminate structure of thermal recording layers that differ in point of the colors which they form, the thermal recording material of the present invention may be for multi-color formation. The thermal recording layers to be laminated include photo-decomposing diazo compound-containing, thermal recording layers. Multi-color thermal recording materials of this type (photosensitive thermal recording materials) are described in, for example, JP-A Nos. 4-135787, 4-144784, 4-144785, 4-194842, 4-247447, 4-247448, 4-340540, 4-340541, 5-34860 and 9-156229. The layer constitution of the recording materials of this type is not specifically defined. For example, preferred are multi-color thermal recording materials having a laminate structure of different thermal recording layers, in which the different thermal recording layers are so combined that each layer contains a diazo compound differing from that in any other layers in point of the sensitive wavelength range and contains a coupler compound capable of thermally reacting with the diazo compound to form a color differing from that to be formed in any other layers. One example of the multi-color thermal recording materials of this type comprises a first thermal recording layer (layer A) that contains a diazo compound of general formula (1) (its absorption peak is shorter than 350 reacting with the diazo compound to form a color, and a compound of general formula (3); a second thermal recording layer (layer B) that contains a diazo compound having an absorption peak at 360 nm±20 nm, and a coupler compound capable of thermally reacting with the diazo compound to form a color; and a third thermal recording layer (layer C) that contains a diazo compound having a peak absorption at 400 nm±20 nm, and a coupler compound capable of thermally reacting with the diazo compound to form a color, in which the layers A to C are laminated in that order on the support. When the recording material of this example is so designed that the colors to be formed in the different thermal recording layers therein are three primary colors for subtractive color mixture, yellow, magenta and cyan, then it enables full-color image formation thereon.

Regarding the layer constitution of the full-color recording material of this type, the layers for yellow, magenta and cyan formation may be laminated in any desired order on the support. For better color reproduction, however, preferred is laminating yellow, cyan and magenta layers in that order on the support, or laminating yellow, magenta and cyan layers in that order thereon.

For recording an image on the multi-color thermal recording material, the third thermal recording layer (layer C) is first heated to thereby induce the reaction of the diazo compound with the coupler compound therein to form a color. Next, the material is exposed to light of 400±20 nm to decompose the non-reacted diazo compound in the layer C; and then this is heated enough for color formation in the second thermal recording layer (layer B) so that the diazo compound is reacted with the coupler compound therein to form a color. In this stage, the layer C is also strongly heated, but the diazo compound therein has been already decomposed and has lost its color-forming ability. Therefore, in this stage, the layer C does not form a color. Next, the material is exposed to light of 360±20 nm to decompose the non-reacted diazo compound in the layer B. Finally, the material is heated enough for color formation in the first thermal recording layer (layer A) to thereby form a color therein. In the last stage, the thermal recording layers, layer C and the layer B are also strongly heated, but the diazo compounds therein have been already decomposed and have lost their color-forming ability. Therefore, in the last stage, the two layers form no color. One preferred embodiment of the thermal recording material of the present invention is such a multi-color thermal recording material as above.

The multi-color thermal recording material of this type may have interlayers between the neighboring thermal recording layers for preventing mutual color mixture in the recording layers. The interlayer may be formed of a water-soluble polymer compound such as gelatin, phthalated gelatin, polyvinyl alcohol or polyvinylpyrrolidone, and may contain various additives.

In cases where the multi-color thermal recording material has a photo-fixing, thermal recording layer, either one or both of a transmittance control layer or a protective layer are optionally but preferably formed above that layer. The transmittance control layer is described, for example, in JP-A Nos. 9-39395 and 9-39396; and JP-A No. 9-95487.

In the present invention, the transmittance control layer contains a component that functions as a UV absorbent precursor, in which the component does not function as a UV absorbent before exposed to light necessary for image fixation. Therefore, the transmittance of the transmittance control layer is high; and when the photo-fixing, thermal recording layer is optically fixed through it, the transmittance control layer well transmits the light necessary for the intended image fixation. In addition, its visible light transmittance is also high, the transmittance control layer does not interfere at all with the image fixation in the thermal recording layer.

The UV absorbent precursor in the transmittance control layer comes to function as a UV absorbent through exposure to light or heat after the underlying, photo-fixing thermal recording layer has been exposed to light necessary for image fixation therein. With that, therefore, most UV rays are absorbed by the UV absorbent therein, and the transmittance control layer in that condition could no more transmit so much light. As a result, the lightfastness of the thermal recording material is enhanced by the transmittance control layer therein. However, since the transmittance control layer could not absorb visible rays, the visible ray transmittance of the recording material does not substantially change.

At least one transmittance control layer may be disposed in the photo-fixing, thermal recording material. Most preferably, it is formed between the photo-fixing, thermal recording layer and the protective layer in the material. As the case may be, the protective layer may be so designed that it functions also as such a transmittance control layer.

Preferably in the thermal recording material of the present invention, two different photo-fixing, thermal recording layers are disposed on the other thermal recording layers as above, and a transmittance control layer and a protective layer are further disposed thereon in that order. In this, the two photo-fixing, thermal recording layers differ from each other in point of the peak absorption of the diazo compound therein, each containing such a different diazo compound and a coupling component corresponding thereto and capable of reacting with it to form a color that differs from the color formed in the other layer.

EXAMPLES

The present invention is described in detail with reference to the following Examples, which, however, are not intended to restrict the scope of the present invention. Unless otherwise specifically indicated, "part" and "%" in the following are all by weight.

Example 1

<Support with Undercoat Layer>

40 parts of enzyme-processed gelatin (mean molecular weight: 10000, PAGI viscosity: 1.5 mPa·s (15 mP), PAGI jelly strength: 20 g) was added to and dissolved in 60 parts of ion-exchanged water with stirring to prepare an aqueous gelatin solution for undercoat layer.

Separately therefrom, 8 parts of water-swellable synthetic mica (aspect ratio: 1000, trade name: SOMASHIF ME100 by Corp-Chemical) was mixed with 92 parts of water, and milled in wet in a viscomill to prepare a mica dispersion having a mean particle size of 2.0 $\mu$m. Water to make the mica concentration 5% was added to this, and uniformly mixed to obtain a desired mica dispersion.

Next, 120 parts of water and 556 parts of methanol were added to 100 parts of the aqueous 40% gelatin solution for undercoat layer at 40° C., and well stirred and mixed, and then, 208 parts of the 5% mica dispersion was added thereto and well stirred and mixed. To this was added 9.8 parts of 1.66% polyethylene oxide surfactant. While the mixture was kept at 35 to 40° C., 7.3 parts of a gelatin hardener, ethylene diglycidyl ether was added to this to prepare a coating liquid (5.7%) for undercoat layer.

The coating liquid was applied onto one surface of a support, woodfree paper laminated with a polyethylene film on both surfaces, to such a degree that the coating mica could be 0.2 g/m$^2$. Thus was formed an undercoat layer on the support.

<Preparation of Diazonium Salt Microcapsule Suspensions>

(i-1) Preparation of Diazonium Salt Microcapsule Suspension (a):

3.2 parts of a diazonium salt compound (A) mentioned below (peak absorption wavelength 420 nm) and 10.7 parts of diphenyl phthalate were added to 15.0 parts of ethyl acetate, and uniformly dissolved therein under heat. To the resulting mixture, added was 9.7 parts of a capsule wall material, mixture of xylylene diisocyanate/trimethylolpropane adduct and xylylene diisocyanate/bisphenol A adduct (trade name: TAKENATE D119N (50% solution in ethyl acetate) by Takeda Chemical Industries), and uniformly stirred to prepare a mixture (I).

Separately therefrom, 18.1 parts of ion-exchanged water and 0.38 parts of SCRAPH AG-8 (50%) (by Nippon Seika) were added to 65 parts of aqueous 8% phthalated gelatin solution, and the mixture (I) (solution) of the diazonium salt compound (A) prepared in the above was added thereto. This was emulsified and dispersed at 40° C., using a homogenizer (by Nippon Seiki Seiskusho). 10 parts of water was added to the resulting emulsion and homogenized. This was stirred at 40° C. for 3 hours, and microcapsules were formed therein. Next, ion-exchange resins, 4.6 parts of AMBERLITE IRA68 (by Organo) and 9.2 parts of AMBERLITE IRC50 (by Organo) were added thereto, and further stirred for 1 hour. Then, the ion-exchange resins were removed from it through filtration. 0.7 parts of aqueous 5% hydroquinone solution was added to it and stirred. Then, the resulting microcapsule suspension was processed to have a solid concentration of 24.5%. This is a diazonium salt microcapsule suspension (a).

Diazonium Salt Compound (A):

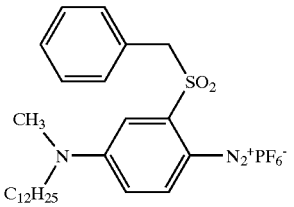

(i-2) Preparation of Diazonium Salt Microcapsule Suspension (b):

3.4 parts of a diazonium salt compound (B) mentioned below (peak absorption wavelength 365 nm), 5.7 parts of tricresyl phosphate, 5.7 parts of isopropylbiphenyl, 0.2 parts of 2,2-dimethoxy-1,2-diphenylethan-1-one (trade name: IRGACURE 651, by Ciba Speciality Chemicals) and 0.5 parts of diphenyl-(2,4,6-trimethylbenzoyl)phosphine oxide (trade name: LUCIRIN TPO, by BASF Japan) were added to 15.1 parts of ethyl acetate, and uniformly dissolved therein under heat. To the resulting mixture, added were capsule wall materials, 14.1 parts of a mixture of xylylene diisocyanate/trimethylolpropane adduct and xylylene diisocyanate/bisphenol A adduct (trade name: TAKENATE D119N (50% solution in ethyl acetate) by Takeda Chemical Industries) and 0.4 parts of polymethylene-polyphenyl polyisocyanate (trade name: MILLIONATE MR-200, by Nippon Urethane Industries), and uniformly stirred to prepare a mixture (II).

Separately therefrom, 25.2 parts of ion-exchanged water and 0.4 parts of SCRAPH AG-8 (50%) (by Nippon Seika) were added to 66.1 parts of aqueous 8% phthalated gelatin solution, and the mixture (II) (solution) of the diazonium salt compound (B) prepared in the above was added thereto. This was emulsified and dispersed at 40° C., using a homogenizer (by Nippon Seiki Seisakusho). 10 parts of water was added to the resulting emulsion and homogenized. This was stirred at 40° C. for 0.5 hours to form microcapsules therein. Then, this was further stirred at an elevated temperature 50° C. for 2.5 hours to complete the microcapsule formation therein. Next, ion-exchange resins, 15 parts of AMBERLITE IRA68 (by Organo) and 30 parts of AMBERLITE IRC50 (by Organo) were added thereto, and further stirred for 1 hour. Then, the ion-exchange resins were removed from it through filtration. The resulting microcapsule suspension was processed to have a solid concentration of 23%. This is a diazonium salt microcapsule suspension (b).

Diazonium Salt Compound (B):

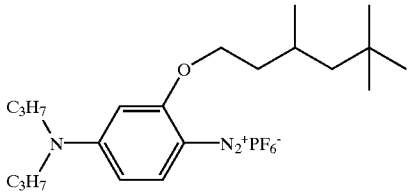

(i-3) Preparation of Diazonium Salt Microcapsule Suspension (c):

4.6 parts of a diazonium salt compound (C) mentioned below (peak absorption wavelength not longer than 350 nm) and 10.4 parts of phenyl 2-(benzoyloxy)benzoate were added to 15.1 parts of ethyl acetate, and uniformly dissolved therein under heat. To the resulting mixture, added were capsule wall materials, 1.3 parts of xylylene diisocyanate/trimethylolpropane adduct (trade name: TAKANATE D110N (75% solution in ethyl acetate), by Takeda Chemical Industries), 7.2 parts of xylylene diisocyanate/2-methyl-2,4-pentanediol adduct (50% solution in ethyl acetate, by Takeda Chemical Industries) and 2.4 parts of polymethylene-polyphenyl polyisocyanate (trade name: MILLIONATE MR-200, by Nippon Urethane Industries), and uniformly stirred to prepare a mixture (III).

Separately therefrom, 13.8 parts of ion-exchanged water and 0.41 parts of SCRAPH AG-8 (50%) (by Nippon Seika) were added to 62.7 parts of the same aqueous phthalated gelatin solution as in the above, and the mixture (III) (solution) of the diazonium salt compound (C) prepared in the above was added thereto. This was emulsified and dispersed at 40° C., using a homogenizer (by Nippon Seiki Seisakusho). 70 parts of water and 0.26 parts of diethylenetriamine were added to the resulting emulsion and homogenized. This was stirred at 40° C. for 1.0 hour to form microcapsules therein. Then, this was further stirred for 2.0 hours at an elevated temperature 60° C. to complete the microcapsule formation therein. Then, its temperature was lowered to 40° C., and ion-exchange resins, 7.5 parts of AMBERLITE IRA68 (by Organo) and 15 parts of AMBERLITE IRC50 (by Organo) were added thereto, and further stirred for 1 hour. Then, the ion-exchange resins were removed from it through filtration. 0.21 parts of aqueous 5% hydroquinone solution was added to it, and stirred. The resulting microcapsule suspension was processed to have a solid concentration of 20%. This is a diazonium salt microcapsule suspension (c). Measured with a particle size analyzer (LA-700, by Horiba Seisakusho), the particle size of the microcapsules formed was 0.37±0.05 $\mu$m in terms of the median diameter thereof.

Diazo Compound (C):

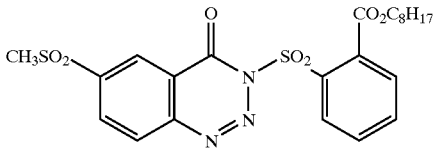

<Preparation of Coupler Emulsions>

(ii-1) Preparation of Coupler Emulsion (d):

In 31.9 parts of ethyl acetate, dissolved were 5.2 parts of a coupler compound (D) mentioned below, 3.3 parts of triphenylguanidine (by Hodogaya Chemical), 20 parts of 4,4'-(m-phenylenediisopropylidene)diphenol (trade name: BISPHENOL M, by Mitsui Petrochemical), 13.3 parts of 4-(2-ethyl-1-hexyloxy)benzenesulfonamide (by Manac), 6.8 parts of 4-n-pentyloxybenzenesulfonamide (by Manac), 1.6 parts of 3,3,3',3'-tetramethyl-5,5',6,6'-tetra(1-propyloxy)-1,1'-spirobisindane (by Sankyo Chemical), 6.8 parts of tricresyl phosphate and 4.2 parts of calcium dodecylbenzenesulfonate/70% methanol solution (trade name: PIONIN A-41-C, by Takemoto Yushi) to prepare a mixture (IV).

Separately therefrom, 25.5 parts of alkali-processed low-ion gelatin (trade name: #750 GELATIN, by Nitta Gelatin), 0.7286 parts of 1,2-benzothiazolin-3-one (3.5% solution in methanol, by Daito Chemical Industry), 0.153 parts of calcium hydroxide, and 143.6 parts of ion-exchanged water were mixed, and dissolved at 50° C. to prepare an aqueous gelatin solution for coupler emulsification. 158.1 parts of the solution was mixed with 137.5 parts of ion-exchanged water, and the coupler mixture (IV) prepared in the above was added thereto. This was emulsified and dispersed, using a homogenizer (by Nippon Seiki Seisakusho). The resulting coupler emulsion was heated under reduced pressure to remove ethyl acetate. Then, this was processed to have a solid concentration of 20%. This is a coupler emulsion (d).

Coupler Compound (D):

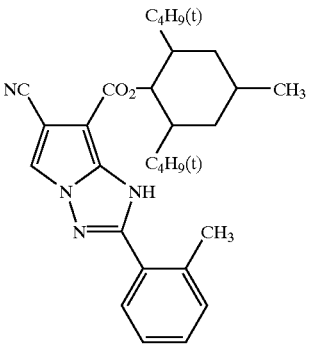

(ii-2) Preparation of Coupler Emulsion (e):

In 37.3 parts of ethyl acetate, dissolved were 4.47 parts of a coupler compound (E) mentioned below, 1.87 parts of triphenylguanidine (by Hodogaya Chemical), 4.39 parts of 4,4'-(m-phenylenediisopropylidene)diphenol (trade name: BISPHENOL M, by Mitsui Petrochemical), 1.4 parts of α-tocopherol, 5.84 parts of tricresyl phosphate and 1.63 parts of calcium dodecylbenzenesulfonate/70% methanol solution (trade name: PIONIN A-41-C, by Takemoto Yushi) to prepare a mixture (V).

Separately therefrom, 25.5 parts of alkali-processed low-ion gelatin (trade name: #750 GELATIN, by Nitta Gelatin), 0.7286 parts of 1,2-benzothiazolin-3-one (3.5% solution in methanol, by Daito Chemical Industry), 0.153 parts of calcium hydroxide, and 143.6 parts of ion-exchanged water were mixed, and dissolved at 50° C. to prepare an aqueous gelatin solution for coupler emulsification. 49.3 parts of the solution was mixed with 45.5 parts of ion-exchanged water, and the coupler mixture (V) prepared in the above was added thereto. This was emulsified and dispersed, using a homogenizer (by Nippon Seiki Seisakusho). The resulting coupler emulsion was heated under reduced pressure to remove ethyl acetate. Then, this was processed to have a solid concentration of 20%. This is a coupler emulsion (e).

Coupler Compound (E):

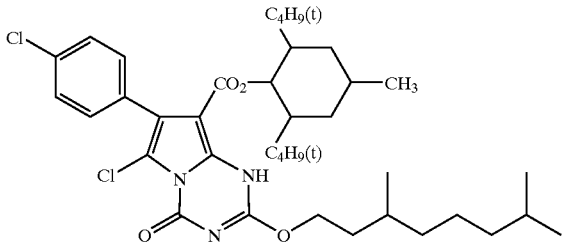

(ii-3) Preparation of Coupler Emulsion (f):

In 49 parts of ethyl acetate, dissolved were 6.0 parts of a coupler compound (F) mentioned below, 6.0 part of a zinc compound (A) mentioned below, 1.9 parts of triphenylguanidine (by Hodogaya Chemical), 6.5 parts of zinc 2-ethylhexanoate, 5.0 parts of tricresyl phosphate and 0.8 parts of calcium dodecylbenzenesulfonate/70% methanol solution (trade name: PIONIN A-41-C, by Takemoto Yushi) to prepare a mixture (VI).

Separately therefrom, 25.5 parts of alkali-processed low-ion gelatin (trade name: #750 GELATIN, by Nitta Gelatin), 0.7286 parts of 1,2-benzothiazolin-3-one (3.5% solution in methanol, by Daito Chemical Industry), 0.153 parts of calcium hydroxide, and 143.6 parts of ion-exchanged water were mixed, and dissolved at 50° C. to prepare an aqueous gelatin solution for coupler emulsification. 77 parts of the solution was mixed with 104 parts of ion-exchanged water, and the coupler mixture (VI) prepared in the above was added thereto. This was emulsified and dispersed at 40° C., using a homogenizer (by Nippon Seiki Seisakusho). The resulting coupler emulsion was heated under reduced pressure to remove ethyl acetate. Then, this was processed to have a solid concentration of 17.5%. This is a coupler emulsion (f). Measured with a particle size analyzer (LA-700, by Horiba Seisakusho), the particle size of the coupler emulsion (f) was 0.25±0.05 μm in terms of the median diameter thereof.

Coupler Compound (F):

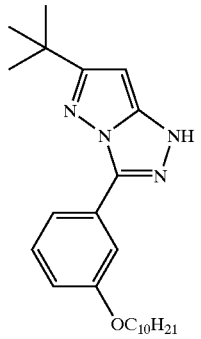

Zinc Compound (A):

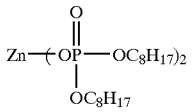

<Preparation of Coating Liquids for Thermal Recording Layer>

(iii-1) Preparation of Coating Liquid (G) for Thermal Recording Layer:

The diazonium salt microcapsule suspension (a) and the coupler emulsion (d) were mixed in a molar ratio, coupler/diazonium salt of 2/1. To the resulting microcapsule mixture, added was 0.2 parts, relative to 10 parts of the mixture, of an aqueous solution of 5% polystyrenesulfonic acid (partially neutralized with potassium hydroxide) to prepare a coating liquid (G) for thermal recording layer.

(iii-2) Preparation of Coating Liquid (H) for Thermal Recording Layer:

The diazonium salt microcapsule suspension (b) and the coupler emulsion (e) were mixed in a molar ratio, coupler/diazonium salt of 3/1. To the resulting microcapsule mixture, added were 0.1385 parts, relative to 10 parts of the mixture, of an aqueous solution of 5% polystyrenesulfonic acid (partially neutralized with potassium hydroxide) and 3.65 parts relative to the same of water to prepare a coating liquid (H) for thermal recording layer.

(iii-3) Preparation of Coating Liquid (I) for Thermal Recording Layer:

The diazonium salt microcapsule suspension (c) and the coupler emulsion (f) were mixed in a molar ratio, coupler/diazonium salt of 3/1. To the resulting microcapsule mixture, added were 0.86 parts, relative to 10 parts of the mixture, of water and 0.166 parts relative to the same of a fluorescent brightener containing 4,4'-bistriazinylaminostilbene-2,2'-disulfonic acid derivative (trade name: KEIKOL BXNL (28%), by Nippon Soda) to prepare a coating liquid (I) for thermal recording layer.

<Preparation of Coating Liquid for Interlayer>

10.0 parts of aqueous 15% alkali-processed low-ion gelatin (trade name: #750 GELATIN, by Nitta Gelatin) solution, 0.05 parts of sodium 4-[(4-nonylphenoxy)-tri(oxyethylene)] butylsulfonate (by Sankyo Chemical, aqueous 2.0% solution), 1.5 parts of boric acid (aqueous 4.0% solution), 0.19 parts of aqueous 5% polystyrenesulfonic acid (partially neutralized with potassium hydroxide) solution, 4.53 parts of aqueous 4% mixture of N,N'-ethylene-bis (vinylsulfonylacetamide), N,N'-trimethylene-bis (vinylsulfonylacetamide) and sodium citrate (by Wako Pure Chemical), and 0.67 parts of ion-exchanged water were mixed to prepare a coating liquid for interlayer.

<Preparation of Coating Liquid for Transmittance Control Layer>

(iv-1) Preparation of UV Absorbent Precursor Microcapsule Suspension:

In 71 parts of ethyl acetate, uniformly dissolved were 14.5 parts of a UV absorbent precursor, [2-allyl-6-(2H-benzotriazol-2-yl)-4-t-octylphenyl] benzenesulfonate, 5.0 parts of 2,5-bis(t-octyl)hydroquinone, 1.9 parts of tricresyl phosphate, 5.7 parts of a-methylstyrene dimer (trade name: MSD-100, by Mitsui Chemical), and 0.45 parts of calcium dodecylbenzenesulfonate/70% methanol solution (trade name: PIONIN A-41-C, by Takemoto Yushi). To the resulting mixture, added was 54.7 parts of a capsule wall material, xylylene diisocyanate/trimethylolpropane adduct (trade name: TAKENATE D110N (7 wt. % solution in ethyl acetate), by Takeda Chemical Industries), and uniformly stirred to prepare a UV absorbent precursor mixture (VII).

Separately therefrom, 8.9 parts of aqueous 30% phosphoric acid and 532.6 parts of ion-exchanged water were mixed with 52 parts of itaconic acid-modified polyvinyl alcohol (trade name: KL-318, by Kuraray) to prepare an aqueous PVA solution for UV absorbent precursor microcapsule formation.

To 516.06 parts of the aqueous PVA solution, added was the UV absorbent precursor mixture (VII) prepared in the above. This was emulsified and dispersed at 20° C., using a homogenizer (by Nippon Seiki Seisakusho). 254.1 parts of water was added to the resulting emulsion and homogenized. This was stirred at 40° C. for 3 hours, and microcapsules were formed therein. Next, 94.3 parts of an ion-exchange resin, AMBERLITE MB-3 (by Organo) was added thereto, and further stirred for 1 hour. Then, the ion-exchange resin was removed from it through filtration. The resulting microcapsule suspension was processed to have a solid concentration of 13.5%. The microcapsules formed had a particle size of 0.30 $\mu$m. To 859.1 parts of the microcapsule suspension, added were 2.416 parts of carboxy-modified styrene-butadiene latex (trade name: SN-307 (aqueous 48% solution), by Sumitomo Norgatac) and 39.5 parts of ion-exchanged water to prepare a UV absorbent precursor microcapsule suspension.

(iv-2) Preparation of Coating Liquid for Transmittance Control Layer:

1000 parts of the UV absorbent precursor microcapsule suspension prepared in the above, 5.2 parts of potassium N-(perfluoro-1-octanesulfonyl)-N-propylaminoacetate (trade name: MEGAFAC F-120, by Dai-Nippon Ink Chemical Industry) (aqueous 5% solution), 7.75 parts of aqueous 4% sodium hydroxide solution, and 73.39 parts of aqueous 2% sodium 4-{(4-nonylphenoxy)-trioxyethylene}butylsulfonate solution (by Sankyo Chemical) were mixed to prepare a coating liquid for transmittance control layer.

<Preparation of Coating Liquid for Protective Layer>

(v-1) Preparation of Polyvinyl Alcohol Solution for Protective Layer:

160 parts of vinyl alcohol-alkyl vinyl ether copolymer (trade name: EP-130, by Denki Kagaku Kogyo), 8.74 parts of a mixture of sodium alkylsulfonate and polyoxyethylene alkyl ether phosphate (trade name: NEOSCORE CM-57 (aqueous 54% solution), by Toho Chemical), and 3832 parts of ion-exchanged water were mixed, and dissolved at 90° C. for 1 hour to prepare a uniform polyvinyl alcohol solution for protective layer.

(v-2) Preparation of Pigment Dispersion for Protective Layer:

8 parts of barium sulfate (trade name: BF-21F, having a barium sulfate content of at least 93%, by Sakai Chemical Industry) was mixed with 0.2 parts of anionic, special polycarboxylic acid-type polymer surfactant (trade name: POISE 532A (aqueous 40% solution), by Kao) and 11.8 parts of ion-exchanged water, and milled in a Dyno mill to prepare a pigment dispersion for protective layer. Measured with a particle size analyzer (LA-910, by Horiba Seisakusho), the particle size of the dispersion was at most 0.30 $\mu$m in terms of the median diameter thereof.

(v-3) Preparation of Matting Agent Dispersion for Protective Layer:

220 parts of wheat starch (trade name: WHEAT STARCH S, by Shinshin Food Industry) was mixed with 3.81 parts of an aqueous dispersion of 1,2-benzisothiazolin-3-one (trade name: PROXEL B.D, by ICI) and 1976.19 parts of ion-exchanged water, and uniformly dispersed to prepare a matting agent dispersion for protective layer.

(v-4) Preparation of Blended Coating Liquid for Protective Layer:

1000 parts of the polyvinyl alcohol solution prepared in the above, 40 parts of potassium N-(perfluoro-1-octanesulfonyl)-N-propylaminoacetate (trade name: MEGAFAC F-120, by Dai-Nippon Ink Chemical Industry) (aqueous 5% solution), 50 parts of aqueous 2.0 wt. % sodium 4-{(4-nonylphenoxy)-trioxyethylene}butylsulfonate solution (by Sankyo Chemical), 49.87 parts of the pigment dispersion prepared in the above, 16.65 parts of the matting agent dispersion prepared in the above, and 48.70 parts of zinc stearate dispersion (trade name: HYDRIN F 115, aqueous 20.5% solution, by Chukyo Yushi) were uniformly mixed to prepare a blended coating liquid for protective layer.

<Application of Coating Liquids to Fabricate Thermal Recording Material>

The coating liquid (I) for thermal recording layer, the coating liquid for interlayer, the coating liquid (H) for thermal recording layer, the coating liquid for interlayer, the coating liquid (G) for thermal recording layer, the coating liquid for transmittance control layer, and the coating liquid for protective layer were continuously applied onto the undercoat layer of the support in that order to form thereon the seven layers, and directly dried at 30° C. and 30% RH and then at 40° C. and 30% RH to complete a multi-color thermal recording layer.

In the coating operation, the amount of the coating liquid (I) was controlled such that the diazonium salt compound (C) therein could be 0.42 mmols/m$^2$ in terms of the dry weight; that of the coating liquid (H) was controlled such that the diazonium salt compound (B) therein could be 0.40 mmols/m$^2$ in terms of the dry weight; and that of the coating liquid (G) was controlled such that the diazonium salt compound (A) therein could be 0.30 mmols/m$^2$ in terms of the dry weight.

The amount of the coating liquid for interlayer was controlled such that its dry weight could be 3.25 g/m$^2$; that of the coating liquid for transmittance control layer was controlled such that its dry weight could be 2.35 g/m$^2$; and that of the coating liquid for protective layer was controlled such that its dry weight could be 1.39 g/m$^2$.

Evaluation

1. Thermal Recording:

The thermal recording material fabricated in the manner as above was exposed to a UV lamp (emission center wavelength 420 nm, power 40 W) for 10 seconds and then to a UV lamp (emission center wavelength 365 nm, power 40 W) for 15 seconds. Next, using a Kyocera's thermal head, KST Model, this was printed. The printing power and the pulse width to the thermal head were so determined that the recording energy/unit area could fall between 80 and 120 mJ/mm$^2$. The printed image was yellow.

2. Lightfastness Evaluation:

The thermal-printed samples were exposed to a light emitter, WEATHOMETER C165 (by Atlas Electric Device) for 48 and 96 hours. The wavelength of the light to which they were exposed was 420 nm, and the light energy applied to them was 0.9 W/m$^2$. After thus exposed, the image density retention in the area of which the original image density was 1.1 was measured. The data are given in Table 1 below.

Examples 2 to 6, Comparative Examples 1 to 3

Thermal recording materials of Examples 2 to 6 and Comparative Examples 1 to 3 were fabricated and tested in the same manner as in Example 1, for which, however, the coupler compound and the zinc compound shown in Table 1 were used in place of the combination of the coupler compound (F) and the zinc compound (A) in Example 1. The data of these samples are given in Table 1.

TABLE 1

| | Coupler Compound | Zinc Compound | Lightfastness 48 hrs | Lightfastness 96 hrs |
|---|---|---|---|---|
| Example 1 | (F) | (A) | 91% | 76% |
| Example 2 | (F) | (B) | 92% | 70% |
| Example 3 | (G) | (B) | 91% | 76% |
| Example 4 | (H) | (B) | 91% | 84% |
| Comp. Ex. 1 | (F) | no | 65% | 58% |
| Comp. Ex. 2 | (G) | no | 63% | 50% |
| Comp. Ex. 3 | (H) | no | 60% | 51% |

Coupler Compound (G):

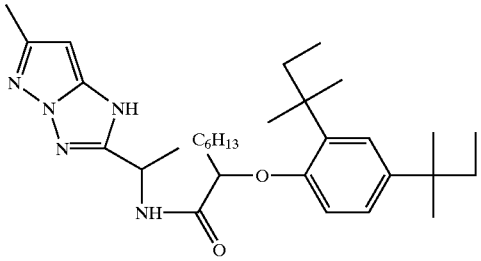

Coupler Compound (H):

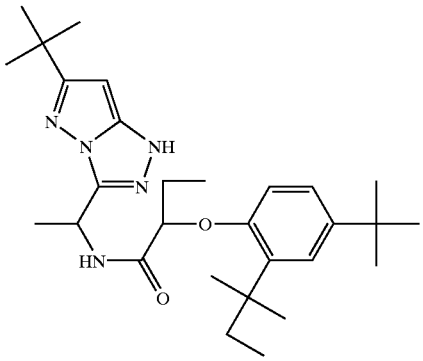

Zinc Compound (B):

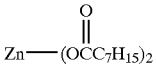

From the data as above, it is understood that the samples of the thermal recording material of the present invention in which the thermal recording layer contains the compounds of general formulae (1) to (3) all have good lightfastness and good image storability.

Since the thermal recording material of the present invention contains a specific diazo compound and a specific coupler compound, it produces an extremely high color density. In addition, since the diazo compound in the material is a fixless compound, the lightfastness of the material is good. Even when exposed to light in a broad wavelength range, or even when exposed to high-temperature surroundings, the material has no background fogging, and its image storability is good. In addition, the compound of general formula (3) in the recording material of the present invention further enhances the lightfastness of the image formed.

What is claimed is:

1. A thermal recording material comprising:

a support; and a thermal recording layer provided on the support, and including a compound represented by the following general formula (1), a compound represented by the following general formula (2), and a compound represented by the general formula (3):

General Formula (1)

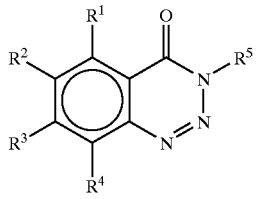

wherein, in general formula (1): $R^1$, $R^2$, $R^3$ and $R^4$ each independently represent a group selected from the group consisting of a hydrogen atom, halogen atoms, alkyl groups, aryl groups, $—OR^{51}$, $—SR^{51}$, $—COOR^{51}$, $—CONR^{51}R^{52}$, $—SO_2R^{51}$, $—SO_2NR^{51}R^{52}$, $—COR^{51}$, $—NR^{51}R^{52}$, nitro groups and cyano groups; $R^{51}$ and $R^{52}$ each independently represent a group selected from the group consisting of a hydrogen atom, alkyl groups, aryl groups and acyl groups; $R^5$ represents a group selected from the group consisting of a hydrogen atom, alkyl groups, aryl groups, $—COOR^{53}$, $—CONR^{53}R^{54}$, $—SO_2R^{53}$, $—SO_2NR^{53}R^{54}$, and $—COR^{53}$; and $R^{53}$ and $R^{54}$ each independently represent a group selected from the group consisting of a hydrogen atom, alkyl groups, aryl groups and acyl groups:

General Formula (2)

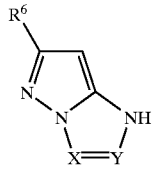

in general formula (2): $R^6$ represents an alkyl group or an aryl group; one of X and Y represents $C—R^7$ and the other of X and Y represents N; and $R^7$ represents an alkyl group or an aryl group, and:

$$R_n—M_m \qquad \text{General Formula (3)}$$

in general formula (3): R represents an anion with a valency from 1 to 3; M represents a metal ion with a valency from 1 to 3; and n and m each independently represents an integer from 1 to 3.

2. The thermal recording material according to claim 1, wherein the compound represented by general formula (1) comprises a solid content coating amount thereof from 0.1 to 0.8 mmol/$m^2$.

3. The thermal recording material according to claim 1, wherein the compound represented by general formula (2) comprises a solid content coating amount thereof from 0.3 to 2.4 mmol/$m^2$.

4. The thermal recording material according to claim 1, wherein the compound represented by general formula (3) comprises a solid content coating amount thereof from 0.3 to 2.4 mmol/$m^2$.

5. The thermal recording material according to claim 1, wherein the compound represented by general formula (2) comprises a proportional amount thereof from 0.1 to 20 mol relative to one mole of the compound represented by general formula (1).

6. The thermal recording material according to claim 1, wherein the compound represented by general formula (3) comprises a proportional amount thereof from 0.01 to 10 mol relative to one mole of the compound represented by general formula (2).

7. The thermal recording material according to claim 1, wherein the anion with a valency from 1 to 3 represented by R in general formula (3) comprises an anion selected from the group consisting of phenol anions, alcohol anions, mercaptan ions, carboxylate ions, sulfonate ions, thiocarboxylate ions, dithiocarboxylate ions, dithiocarbamate ions, thiocarbonate ions, phosphate ions, monoalkylphosphate ions, dialkylphosphate ions, phosphonate ions, acetylacetone ions and salicylate ions.

8. The thermal recording material according to claim 1, wherein the metal ion with a valency from 1 to 3 represented by M in general formula (3) comprises a metal ion selected from the group consisting of $Zn^{2+}$, $Fe^{2+}$, $Fe^{3+}$, $Ni^{2+}$ and $Al^{3+}$.

9. The thermal recording material according to claim 1, wherein the compound represented by general formula (1) comprises the following diazo compound (C):

Diazo Compound (C):

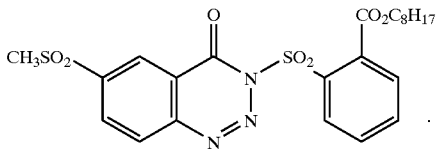

10. The thermal recording material according to claim 1, wherein the compound represented by general formula (2) comprises at least one compound selected from the group consisting of the following coupler compound (F), the following coupler compound (G) and the following coupler compound (H):

Coupler Compound (F):

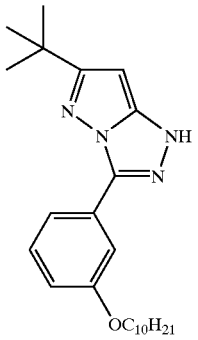

Coupler Compound (G):

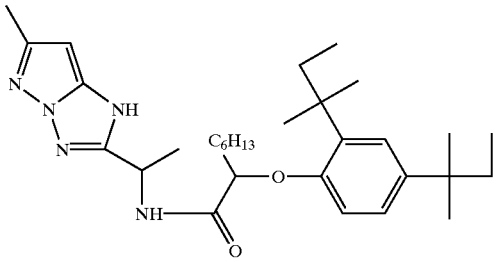

Coupler Compound (H):

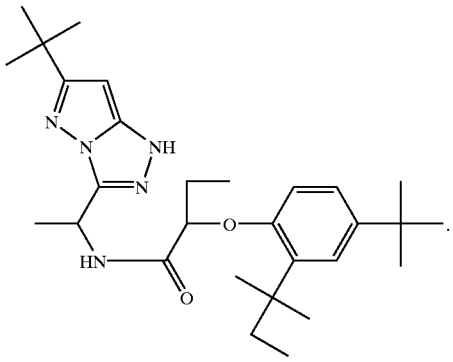

11. The thermal recording material according to claim 1, wherein the compound represented by general formula (3) comprises at least one of the following zinc compounds (A) and (B):

Zinc Compound (A):

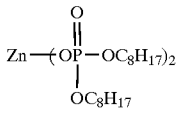

Zinc Compound (B):

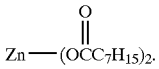

12. The thermal recording material according to claim 1, wherein at least one of the compounds represented by the general formulae (1) to (3) is encapsulated in microcapsules.

13. The thermal recording material according to claim 1, wherein the compound represented by the general formula (1) is encapsulated in microcapsules.

14. The thermal recording material according to claim 1, wherein the thermal recording layer further comprises an organic base.

15. The thermal recording material according to claim 1, wherein the thermal recording layer further comprises a color-formation promoter.

16. The thermal recording material according to claim 1, wherein the thermal recording layer further comprises a free radical generator.

* * * * *